US010527352B2

(12) United States Patent
Vickress et al.

(10) Patent No.: US 10,527,352 B2
(45) Date of Patent: Jan. 7, 2020

(54) WEAR RESISTANT COMPOSITE MATERIAL, ITS APPLICATION IN COOLING ELEMENTS FOR A METALLURGICAL FURNACE, AND METHOD OF MANUFACTURING SAME

(71) Applicant: HATCH LTD., Mississauga (CA)

(72) Inventors: Dustin Alexander Vickress, Mississauga (CA); Ian Archibald Cameron, Dundas (CA); David Henry Rudge, Burlington (CA); Andriy Ponomar, Oakville (CA); Volodymyr Ponomar, Oakville (CA); Maciej Urban Jastrzebski, Toronto (CA); John Andrew Ferguson Shaw, Toronto (CA)

(73) Assignee: HATCH LTD., Mississauga (CA)

( * ) Notice: Subject to any disclaimer, the term of this patent is extended or adjusted under 35 U.S.C. 154(b) by 0 days.

(21) Appl. No.: 16/058,543

(22) Filed: Aug. 8, 2018

(65) Prior Publication Data

US 2018/0347905 A1 Dec. 6, 2018

Related U.S. Application Data

(63) Continuation of application No. PCT/CA2017/050215, filed on Feb. 17, 2017.
(Continued)

(51) Int. Cl.
*F27D 1/00* (2006.01)
*F27D 1/06* (2006.01)
(Continued)

(52) U.S. Cl.
CPC ..... *F27D 1/0006* (2013.01); *F27B 1/24* (2013.01); *F27D 1/06* (2013.01); *F27D 1/08* (2013.01);
(Continued)

(58) Field of Classification Search
CPC ..... B22D 19/08; B22D 19/14; C21B 7/04; C21B 7/06; C21B 7/10; F27B 1/14;
(Continued)

(56) References Cited

U.S. PATENT DOCUMENTS 4,437,651 A * 3/1984 Cordier ..... C21B 7/10 122/6 B
4,752,218 A 6/1988 Nos et al.
(Continued)

FOREIGN PATENT DOCUMENTS

EP 1178274 A1 2/2002
EP 2138791 A1 12/2009
(Continued)

OTHER PUBLICATIONS

Hiroshige , stave, Nov. 22, 1994, 6 pages (Year: 1994).*
(Continued)

*Primary Examiner* — Scott R Kastler
*Assistant Examiner* — Michael Aboagye
(74) *Attorney, Agent, or Firm* — Borden Ladner Gervais LLP; Brandon L. Evenson

(57) ABSTRACT

An abrasion-resistant material for the working face of a metallurgical furnace cooling element such as a stave cooler or a tuyere cooler having a body comprised of a first metal. The abrasion-resistant material comprises a macro-composite material including abrasion-resistant particles which are arranged in a substantially repeating, engineered configuration infiltrated with a matrix of a second metal, the particles having a hardness greater than that of the second metal. A cooling element for a metallurgical furnace has a body comprised of the first metal, the body having a facing layer comprising the abrasion-resistant material. A method comprises: positioning the engineered configuration of abrasion-resistant particles in a mold cavity, the engineered configu-
(Continued)

ration located in an area of the mold cavity to define the facing layer; and introducing molten metal into the cavity, the molten metal comprising the first metal of the cooling element body.

28 Claims, 22 Drawing Sheets

Related U.S. Application Data

(60) Provisional application No. 62/296,944, filed on Feb. 18, 2016.

(51) Int. Cl.
*F27D 1/08* (2006.01)
*F27D 1/12* (2006.01)
*F27B 1/24* (2006.01)
*F27D 9/00* (2006.01)

(52) U.S. Cl.
CPC ..... *F27D 1/12* (2013.01); *F27D 2009/0013* (2013.01); *F27D 2009/0018* (2013.01)

(58) Field of Classification Search
CPC ..... F27B 1/16; F27B 1/22; F27B 1/24; F27D 1/0006; F27D 1/04; F27D 1/06; F27D 1/08; F27D 1/12; F27D 1/16; F27D 2009/0013; F27D 2009/0018; F27D 9/00
USPC ..... 266/190, 193, 194; 428/698, 469, 472, 428/692; 373/72, 73, 74, 75, 76
See application file for complete search history.

(56) References Cited

U.S. PATENT DOCUMENTS 5,251,882 A * 10/1993 Kammerling ..... C21B 7/10 122/6 B
6,234,790 B1 * 5/2001 Van Laar ..... C21B 7/10 266/280
6,580,743 B1 6/2003 Hirata et al.
6,641,777 B1 * 11/2003 Kojo ..... C21B 7/10 122/6 B
2004/0115477 A1 6/2004 Nesbitt et al.
2004/0234820 A1 * 11/2004 Majagi ..... B22F 3/26 428/698

FOREIGN PATENT DOCUMENTS

| | | | | |
|---|---|---|---|---|
| EP | 2733451 | A1 | 5/2014 | |
| GB | 2152432 | A | 8/1985 | |
| JP | H01272707 | A | 10/1989 | |
| JP | H02-010102 | B | 1/1990 | |
| JP | H05-271730 | A1 | 10/1993 | |
| JP | 06-322419 | * | 11/1994 | ..... F27D 1/0006 |
| JP | H08104910 | A | 4/1996 | |
| JP | 2000-273511 | A | 10/2000 | |
| JP | 2001-192715 | A | 7/2011 | |
| JP | 2011219825 | A | 11/2011 | |
| JP | 2017-057424 | A1 | 3/2017 | |
| RU | 2482192 | C2 | 7/2012 | |
| RU | 2557437 | C1 | 7/2015 | |
| WO | 7900431 | A1 | 7/1979 | |

OTHER PUBLICATIONS

European Patent Application No. 17752614.2, Extended European Search Report dated Oct. 24, 2018.
International Patent Application No. PCT/CA2017/050215, International Preliminary Report on Patentability dated Aug. 30, 2018.
International Patent Application No. PCT/CA2017/050215, International Search Report and Written Opinion dated May 19, 2017.
Australian Application No. 2017220495, Examination Report dated Oct. 26, 2018.
Liu Zhiwei et al., Preparation of Porous SiC Reinforced Metal Matrix Composites, Rare Metal Materials and Engineering, Aug. 2007, vol. 36, Suppl. 1, pp. 852-855 (includes English translation of Abstract).

* cited by examiner

WEAR RESISTANT COMPOSITE MATERIAL, ITS APPLICATION IN COOLING ELEMENTS FOR A METALLURGICAL FURNACE, AND METHOD OF MANUFACTURING SAME

CROSS-REFERENCE TO RELATED APPLICATION

This application is a continuation of International Patent Application No. PCT/CA2017/050215. This application claims priority to and the benefit of U.S. Provisional Patent Application No. 62/296,944 filed Feb. 18, 2016, and International Patent Application No. PCT/CA2017/050215 filed Feb. 17, 2017, the contents of which are incorporated herein by reference.

FIELD OF THE INVENTION

The invention generally relates to cooling elements for metallurgical furnaces, such as stave coolers and tuyere coolers for blast furnaces, and particularly to such cooling elements having a working face provided with a layer of composite material comprising abrasive-resistant particles arranged in a matrix of thermally conductive metal.

BACKGROUND OF THE INVENTION

Metallurgical furnaces of various types are used to produce metals. The process usually involves high temperatures, with the product being molten metal and process by-products, generally slag and gases. Furnace walls may be lined with cooling elements, which are typically comprised of copper or cast iron and may include internal flow passages for circulation of a coolant, typically water. For example, the walls of blast furnaces are typically lined with water-cooled cooling elements such as stave coolers and/or tuyere coolers.

Stave coolers are subject to wear caused by contact with hot, abrasive materials present inside the furnace. For example, in a blast furnace, the stave coolers are in contact with a downwardly descending feed burden comprising coke, limestone flux, and iron ore. The descending burden is hot, contains particles of various sizes, weights and shapes, and its hardness is higher than the hardness of materials typically used to manufacture a stave. Consequently, the stave coolers tend to wear out, and worn out stave coolers are typically shut down, meaning that no cooling takes place, and the stave deteriorates completely. This causes the furnace shell to overheat, which, in turn, can lead to a rupture of the shell.

Tuyere coolers are subject to erosion of the inner walls due to gas-entrained carbon-based solids; and abrasion and erosion of the outer wall due to contact with unburned carbon-based solids and molten metal drips. Consequently, tuyere coolers are highly susceptible to wear, leading to water leakage. Worn tuyere coolers are shut down and must be replaced, since damaged tuyeres lower productivity of the furnace and distort circumferential symmetry of hot air injection. This results in production losses and increased throughput through other tuyeres, which increases their likelihood of failure and may result in financial loss due to lost production.

Attempts have been made to improve the wear properties of stave coolers. For example, it has been proposed to attach wear-resistant elements to the working face of a copper stave by means of rotational friction welding, or to deposit a wear-resistant coating on the working face.

It has also been proposed to disperse hardened particles throughout the entire volume of the cooler (e.g. in JP 2001-102715 A). However, due to the relatively high cost of the hardened particles, this approach can be uneconomical since it places most of the wear-resistant particles in areas of the cooler which are not subjected to wear. Also, because the particles are small and dispersed throughout the cooling element, it is difficult to non-destructively evaluate whether they are present at the working face in sufficient concentrations.

It has also been proposed to insert abrasion resistant materials into the bottom of a mold prior to casting of a stave cooler (WO 79/00431 A1). Proposed materials include hard aggregate, such as cemented tungsten carbide, or a stainless steel expanded-metal mesh.

However, mere placement of the abrasion resistant material into the bottom of the mold does not ensure that it will be reliably located at the working face of the cooler in sufficient concentrations, making it difficult to produce a cooling element with consistent abrasion-resistance across its entire working face. While this may be acceptable for plate coolers, which can be readily replaced from the exterior of a blast furnace, it is not acceptable for stave coolers which cannot be replaced without extended downtime.

There remains a need for furnace cooling elements with improved wear properties to improve efficiency of furnace operation and minimize down-time, while maintaining low cost and manufacturability of the cooling elements.

SUMMARY OF THE INVENTION

In one aspect, there is provided a cooling element for a metallurgical furnace. The cooling element has a body comprised of a first metal, the body having at least one surface along which there is provided a facing layer. The facing layer is comprised of a composite material, wherein the composite material comprises abrasion-resistant particles arranged in a matrix of a second metal, the abrasion-resistant particles having hardness greater than a hardness of the first metal and greater than a hardness of the second metal.

In another aspect, there is provided a method for manufacturing a cooling element as disclosed herein. The method comprises: (a) providing an engineered configuration of said abrasion-resistant particles; (b) positioning the engineered configuration of said abrasion-resistant particles in a mold cavity, with the engineered configuration located in an area of the mold cavity which is to define the facing layer of the cooler; and (c) introducing a molten metal into the mold cavity, wherein the molten metal comprises the first metal of the body of the cooling element and the second metal of the composite material.

BRIEF DESCRIPTION OF THE DRAWINGS

The invention will now be described, by way of example only, with reference to the accompanying drawings, in which:

FIGS. 5-1 to 5-8 illustrate abrasion-resistant particles of various shapes;

FIG. 6 is an explanatory view showing square area packing and hexagonal area packing of spherical abrasion-resistant particles in the composite material; and FIG. 7 illustrates an alternate embodiment of a facing layer configuration for the stave cooler shown in FIG. 2, including a close-up of a circled area to better show the shapes of the particles.

DETAILED DESCRIPTION

Figure 1:
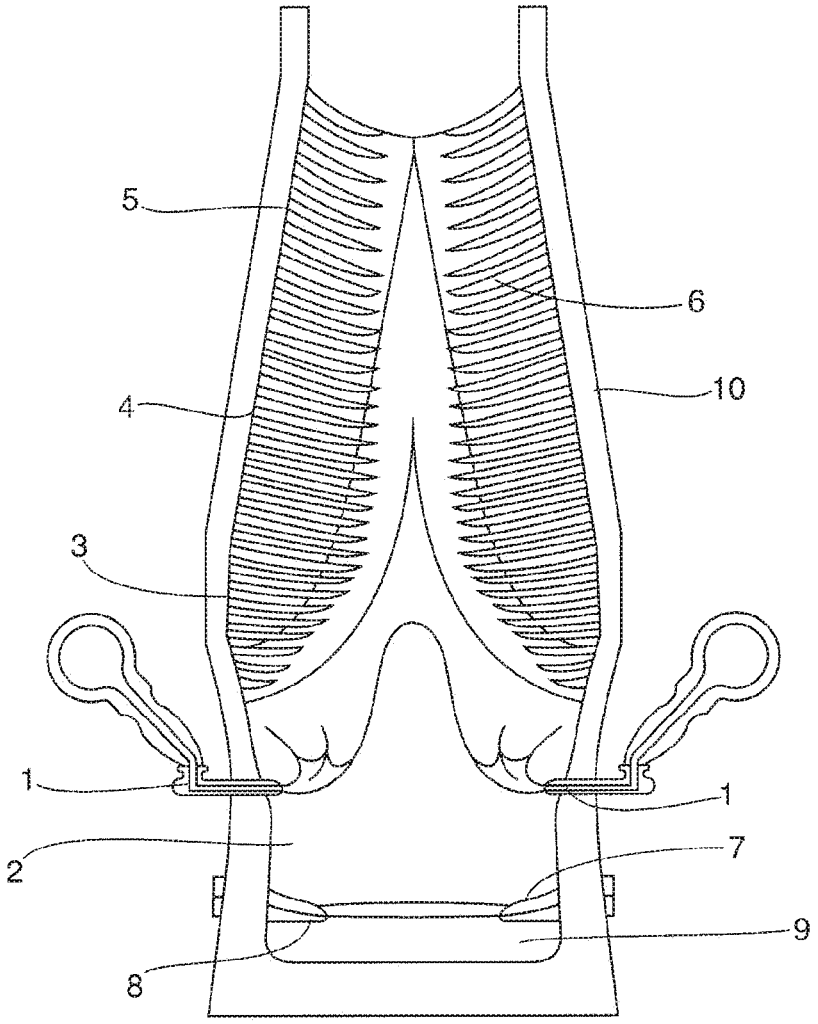
FIG. 1 shows the structure of a blast furnace.

FIG. 1 is an explanatory view showing a conventional blast furnace. A blast furnace is built in the form of a tall structure with a steel shell 10 surrounding an inner lining comprised of refractory bricks and cooling elements.

The blast furnace operates according to the countercurrent exchange principle. A feed burden comprising a column 6 of coke, limestone flux and iron ore is charged from the top of the furnace, and is reduced by a hot gas flowing upwardly through the porous feed burden from tuyere coolers 1 located in a lower portion of the furnace. The descending feed burden is pre-heated in the throat section 5, and then proceeds through two oxygen reduction zones, namely a reduction zone of ferric oxide or "stack" 4; and a reduction zone of ferrous oxide or "belly" 3. The burden then descends down through the melting zone or "bosh" 2, where the tuyere coolers 1 are located, to the hearth 9. The molten metal (pig iron) and slag are then tapped from drilled openings 8 and 7.

FIG. 1 shows a plurality of tuyere coolers 1 located in the furnace lower "bosh" area 2. The tuyere coolers 1 are spaced circumferentially in close proximity to another, to form a ring, the spacing typically being symmetrical. The tuyere coolers 1 function as protective shells for hot air injectors into the furnace, thereby prolonging the operating life of the blast furnace via sustained axisymmetric fuel injection.

Stave coolers are generally located in the belly 3, stack 4 and throat 5 of the blast furnace, one beside another, forming a cooled inner surface of the furnace. The stave coolers function as a thermal protective medium for the furnace shell 10 by accumulating burden buildup, thereby maintaining the structural integrity of the furnace walls and preventing ruptures. Cooling generally involves convective heat exchange between a cooling fluid (usually water) flowing within the cooling passages embedded inside the stave body.

Figure 2:
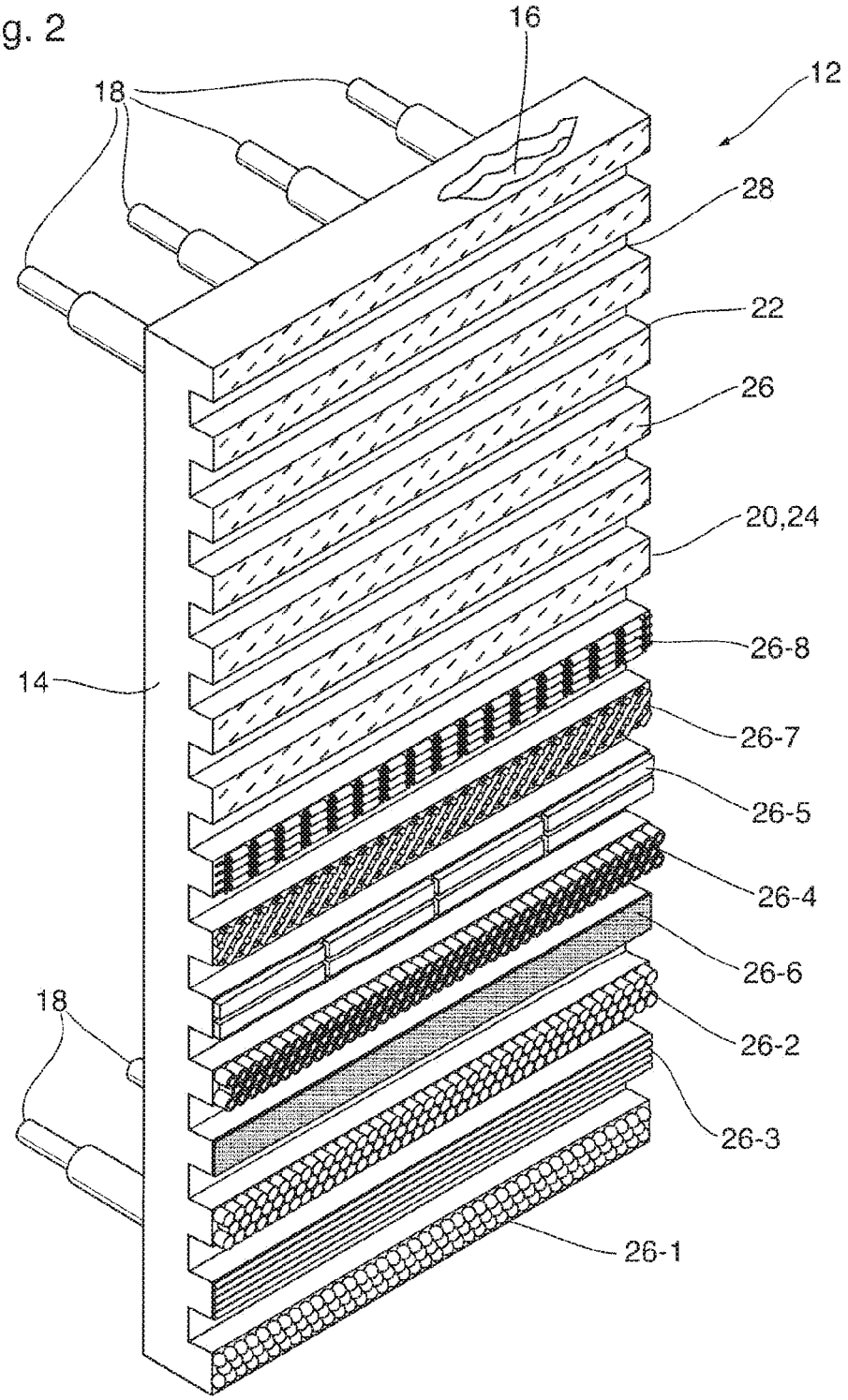
FIG. 2 is a front perspective view of a stave cooler according to a first embodiment.

A cooling element according to a first embodiment comprises a stave cooler 12 having a general structure such as that shown in FIG. 2. The stave cooler 12 comprises a body 14 comprised of a first metal, wherein the body 14 is provided with one or more internal cavities defining one or more internal coolant flow passages 16 (see cut-away in FIG. 2), the flow passages 16 communicating with a coolant circulation system (not shown) located outside the furnace through a plurality of coolant conduits 18 having a length sufficient to extend through the furnace shell 10 (FIG. 1).

The body 14 of stave cooler 12 has at least one surface 20 along which there is provided a facing layer 22. In the embodiment illustrated in FIG. 2, the surface 20 comprises the working face 24 of cooler 12, also referred to as the "hot face", which is directed towards the interior of the furnace and is exposed to contact with the descending column of feed burden 6 (FIG. 1). The working face 24 of the stave cooler 12 of FIG. 2 is shown as having a corrugated structure, which is defined by a plurality of horizontal ribs 26 and a plurality of horizontal valleys 28, in alternating arrangement along the working face 24. This corrugated structure assists in maintaining a protective layer of feed burden on the working face 24.

Although FIG. 2 shows a cooling element in the form of a stave cooler 12 for a blast furnace, it will be appreciated that the embodiments disclosed herein are generally applicable to cooling elements of various configurations, which are subjected to wear by contact with hard, abrasive particulate material within a metallurgical furnace.

Figure 3:
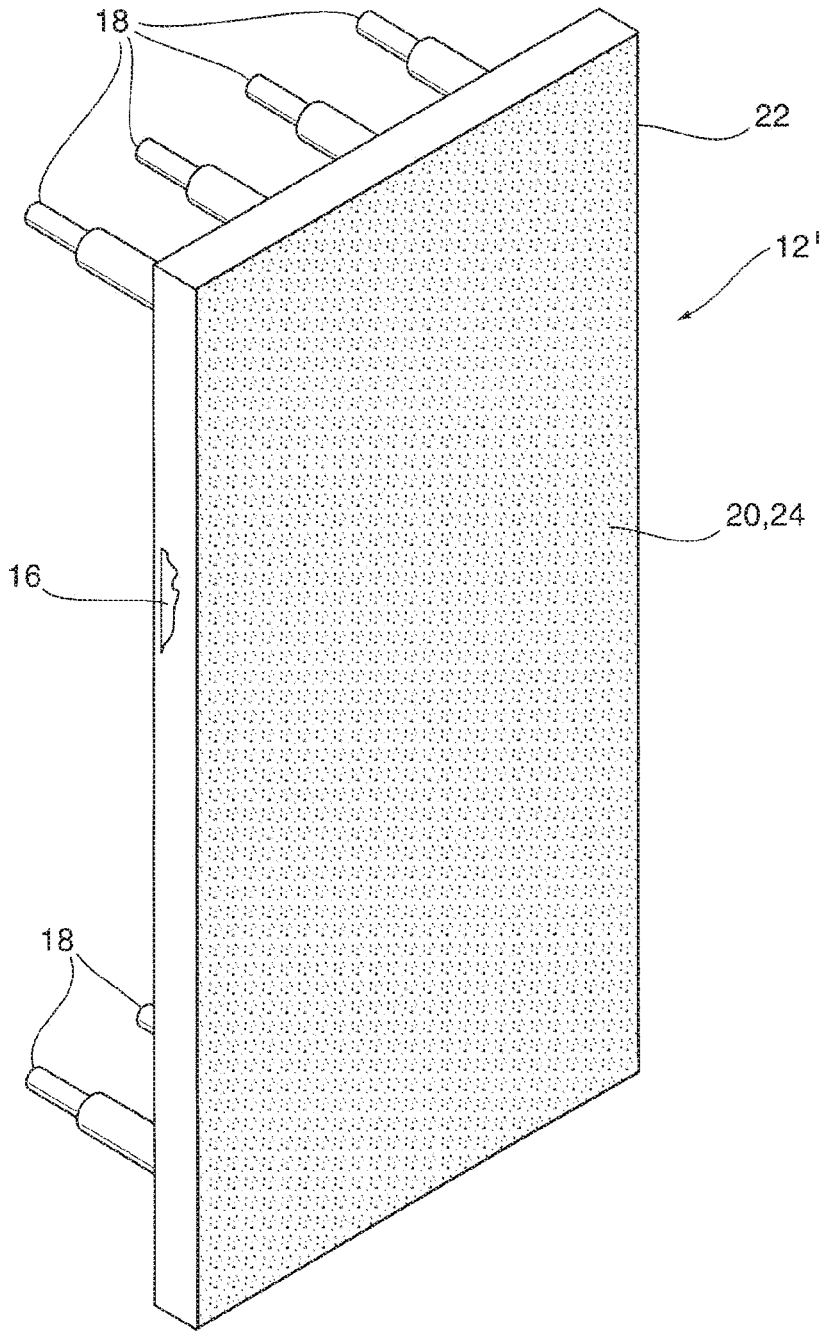
FIG. 3 is a front perspective view of a stave cooler according to a second embodiment.

FIG. 3 illustrates the general structure of a cooling element according to a second embodiment, comprising a stave cooler 12', wherein like reference numerals to those used in connection with the previously described embodiment have been used to identify similar features, where appropriate.

Stave cooler 12' comprises a body 14 comprised of a first metal, wherein the body 14 is provided with one or more internal cavities defining one or more internal coolant flow passages 16 (see cut-away in FIG. 3), the flow passages 16 communicating with a coolant circulation system (not shown) located outside the furnace through a plurality of coolant conduits 18 having a length sufficient to extend through the furnace shell 10 (FIG. 1).

The body 14 of stave cooler 12' has at least one surface 20 along which there is provided a facing layer 22. In the embodiment illustrated in FIG. 3, the surface 20 comprises the working face 24 of cooler 12', also referred to as the "hot face", which is directed towards the interior of the furnace and is exposed to contact with the descending column of feed burden 6. In contrast to stave cooler 12 shown in FIG. 2, the working face 24 of stave cooler 12' of FIG. 2 is shown as having a substantially flat, level surface with relatively little height or depth. Therefore, in the present embodiment, substantially the entire working face 24 of stave cooler 12' is exposed to contact with the descending column of feed burden 6 (FIG. 1).

Figure 4:
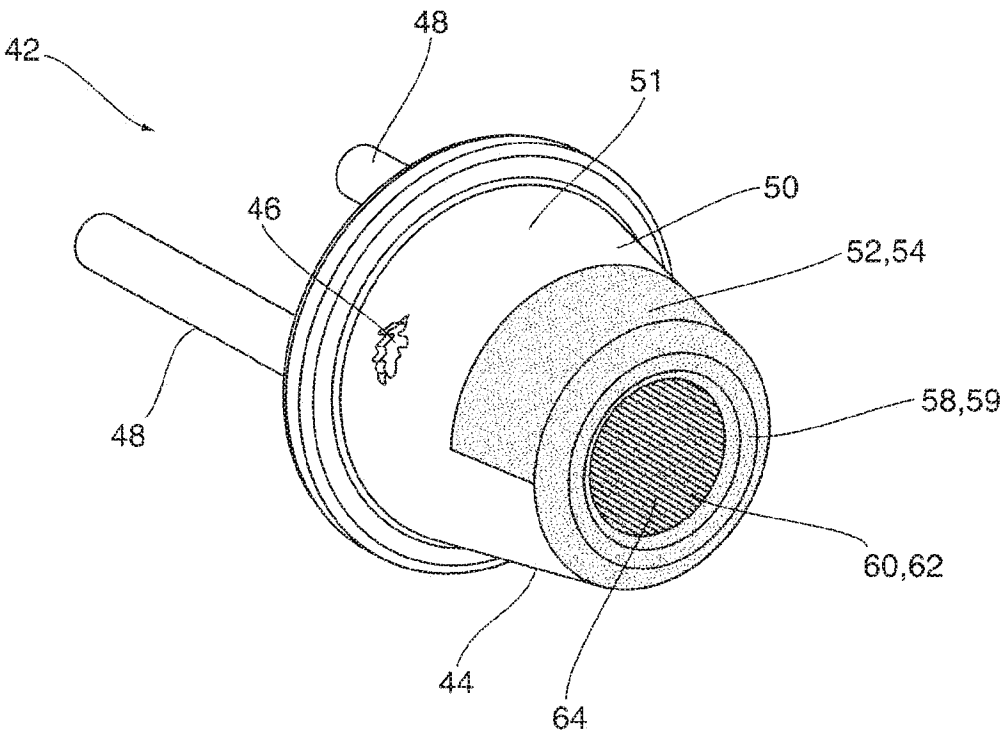
FIG. 4 is a front perspective view of a tuyere cooler.

FIG. 4 illustrates the general structure of a cooling element according to a third embodiment, comprising a tuyere cooler 42, wherein like reference numerals to those used in connection with the previously described embodiments have been used to identify similar features, where appropriate.

Tuyere cooler 42 may comprise a body 44 comprising a hollow shell in the form of a truncated cone which is open at both ends. The body 44 comprises a sidewall 50 defining the truncated conical shape of the body 44, the sidewall 50 having an outer surface 51 and an inner surface 60. Enclosed within the sidewall 50, between the outer and inner surfaces 51, 60 are one or more internal coolant flow passages 46 (see cut-away in FIG. 4), the flow passages 46 communicating with a coolant circulation system (not shown) located outside the furnace through a plurality of coolant conduits 48 having a length sufficient to extend through the furnace shell 10 (FIG. 1).

As shown in FIG. 4, an outer facing layer 52 is provided over a portion of the outer surface 51 of sidewall 50, the outer facing layer 52 being provided over a first working face 54 of tuyere cooler 42. The first working face 54 is on the outer surface of the cooler 42 and faces upwardly. The application of outer facing layer 52 on first working face 54 is for the purpose of reducing wear abrasion and erosion on the top facing portion of the cooler 42 caused by contact with the descending feed burden in the furnace, contact with unburned carbon-based solids and molten metal drips.

The outer facing layer 52 is also provided over an inwardly facing end surface 58 of the tuyere cooler 42, which defines a second working face 59. The end surface 58 comprises an annular end surface of the sidewall 50 surrounding the central opening through which the tuyere cooler 42 injects air into the bosh 2 (FIG. 1) of the furnace. The end surface 58 is also exposed to contact with the descending feed burden, unburned carbon-based solids and molten metal drips.

The inner surface 60 of the sidewall 50 defines a third working face 62 of the cooling element 42, over which is provided an inner facing layer 64 to reduce wear along the inner surface 60 of sidewall 50 due to the abrasive effects of hot air blasts containing entrained abrasive solids such as carbon-based solids.

The bodies 14, 44 of the cooling elements 12, 12', 42 discussed above are comprised of a first metal having sufficient thermal conductivity and a sufficiently high melting point to permit its use within a metallurgical furnace. The first metal may comprise any metal which is conventionally used in cooling elements of metallurgical furnaces, including cast iron; steel, including stainless steel; copper; and alloys of copper, including copper-nickel alloys such as Monel™ alloys. The body 14, 44 may be formed by casting in a sand casting mold, or in a permanent graphite mold, and may be subjected to one or more machining operations after casting. The coolant flow passages 16, 46 within the body may be formed during or after casting.

Table 1 below compares the hardness of the first metal of the cooling element with the hardness of various components of the furnace feed burden. It can be seen from Table 1 that the hardness of the burden components is generally greater than that of the metals. If left unprotected at the working faces 24, 54, 59 of the cooling element 12, 12', 42, the first metal of the body 14, 44 will be worn at the working faces 24, 54, 59, 62 by at least one of the following two mechanisms: direct abrasion; and gas-driven particle blasting/erosion. Direct abrasion is caused by the downward moving feed burden particles, and specifically by direct, frictional sliding contact between the burden and at least one of the working faces 24, 54, 59 on the outer surface of the cooling element 12, 12', 42. Gas-driven erosion is caused by blasting by particles that are driven by upwardly flowing gas from tuyeres 1. The gas, when passing through a small channel, reaches high velocity and carries small particles of feed burden which scour the external working faces 24, 54, 59. In addition, the third (Internal) working surface 62 of the tuyere cooler 42 is abraded and worn by the high velocity gas flowing through the hollow interior of tuyere cooler 42, which carries small abrasive particles such as blasting coke.

TABLE 1

| Hardness Values of Feed Burden Elements vs. First Metal | |
|---|---|
| Material | Hardness, Mohs |
| Feed Burden Components | |
| Wustite, FeO | 5.0-5.5 |
| Hematite, $Fe_2O_3$ | 5.5-6.5 |
| Magnetite, $Fe_3O_4$ | 5.0-6.5 |
| Coke, C | 5.0-6.0 |
| Limestone, $CaCO_3$ | 3.0-4.0 |
| First Metal of Cooling Element Body | |
| Cast Iron | 4.0 |
| Copper | 2.0 |
| Copper-Nickel Alloy (Monel) | 2.5-4.0 |
| Stainless Steel | 5.5-6.0 |

In the stave coolers 12, 12' disclosed herein, the first metal of the body 14 is protected by a facing layer 22 provided along at least one surface 20 of the body 14, wherein the at least one surface 20 may comprise part or all of the working face 24 of cooling element 12, 12'. For example, in some embodiments, the at least one surface 20 may be limited to the vertical faces of the horizontal ribs 26 which partly define the working face 24 in the stave cooler 12 shown in FIG. 2. In the stave cooler 12' shown in FIG. 3, the at least one surface 20 along which the facing layer 22 is provided may comprise the entire working face 24 of the cooler 12'.

In the tuyere cooler 42, the outer facing layer 52 is provided along part or all of the first and second working faces 54, 58 which are located on the external surface of the body 44. The inner facing layer 64 is provided along at least a portion of the inner surface 60 of sidewall 50, defining the third working face 62.

The facing layers 22, 52, 64 are comprised of a composite material, wherein the composite material comprises abrasion-resistant particles arranged in a matrix of a second metal. The abrasion-resistant particles have a hardness which is greater than the hardness of the first metal comprising the body 14, 44 and may desirably have a hardness of at least about 6.5 Mohs which, as can be seen from Table 1, is equal to or greater than the maximum hardness of the components of the feed burden.

For example, the abrasion-resistant particles of the facing layer 22, 52, 64 may be comprised of one or more abrasion-resistant materials selected from ceramics, including carbides, nitrides, borides and/or oxides. Specific examples of carbides which may be incorporated into the composite material include tungsten carbide, niobium carbide, chromium carbide and silicon carbide. Specific examples of nitrides which may be incorporated into the composite material include aluminum nitride and silicon nitride. Specific examples of oxides which may be incorporated into the composite material include aluminum oxide and titanium oxide. Specific examples of borides which may be incorporated into the composite material include silicon boride.

The abrasion-resistant particles and materials listed above have high strength and a hardness exceeding 6.5 Mohs. For example, each of the carbides listed above has a hardness of 8-9 Mohs. The abrasion-resistant particles and materials listed above are at least as hard as any material commonly encountered in a metallurgical furnace, including the components of the feed burden in a blast furnace. Furthermore, at least some of the listed abrasion-resistant particles and materials, such as tungsten carbide, have relatively high thermal conductivity, which is discussed in more detail below.

The second metal comprising the matrix of facing layer 22, 52, 64 may optionally be identical in composition to the first metal which comprises the body 14, 44 of cooling element 12, 12', 42. For example, the second metal may comprise cast iron; steel, including stainless steel; copper; and alloys of copper, including copper-nickel alloys such as Monel™ alloys.

In an embodiment, the second metal comprising the matrix of facing layer 22, 52, 64 comprises a high copper alloy having a copper content of not less than 96 weight percent. The inventors have found pure copper to be a suitable matrix material for a number of reasons. For example, high copper alloys have high toughness, which makes the composite material resistant to stretching and shearing, and is resilient to thermal deformation. Also, high copper alloys are metallurgically compatible with many materials, and copper is well understood. Finally, high copper alloys have excellent thermal conductivity properties at a reasonable cost. Therefore, when cost, manufacturability, toughness, and thermal conductivity are taken into account, the inventors have found high copper alloys to be an effective matrix material.

It can be seen from the above description that the composite material of the facing layer 22, 52, 64 is comprised of two individual components (i.e. the abrasion-resistant particles and the second metal) having significantly different physical and chemical properties. When combined, these individual components provide the composite material with characteristics different from each of the components, and superior to any single material suitable for manufacturing a cooling element for a metallurgical furnace. For example, the composite material may have an abrasive wear rate, determined in accordance with ASTM G 65, of no more than 0.6 times that of grey cast iron under identical conditions. Advantageously the combination of properties possessed by the composite material include higher wear resistance than is achieved by any conventionally used cooling elements, including cast iron staves, and higher thermal conductivity than cast iron.

The thickness of the facing layer 22, 52, 64 is variable, and may be from about 3 mm to about 50 mm, with the remainder of the body 14, 44 of the cooling element 12, 12', 42 being comprised of the first metal. Because the abrasion-resistant particles may be several times more expensive than the first metal, it is advantageous to confine the abrasion-resistant particles to the facing layer 22, 52, 64 where they are needed. Additionally, because the composite material has lower thermal conductivity than the first metal, confining it to a fraction of the total thickness of the cooling element 12, 52, 64 will minimize the impact of the composite material on the cooling performance of the cooling element 12, 52, 64.

In addition to the compositions of the particles and the second metal, the overall thermal conductivity and wear resistance of the composite material will depend on the interaction between the particles and the matrix, which depends on a number of factors, now described below. Accordingly, the composite material of the facing layer 22, 52, 64 can be tailored to have specific properties suitable for a range of applications.

In this regard, the composite material as described herein may comprise a macro-composite material, in which the abrasion-resistant particles are arranged according to a substantially repeating, engineered configuration designed to produce optimal abrasion-resistance, infiltrated with a matrix of the second metal.

The substantially repeating engineered configuration of the macro-composite has a unit volume which is assumed to be in the shape of a cube with edge length "a", and volume $a^3$. The edge length of the cube defines the envelope size of the repeating engineered configuration, and may be from about 3 mm to about 50 mm. The edge length "a" is defined so that a single abrasion-resistant particle will fit within the envelope size of the repeating engineered configuration, regardless of its shape and orientation. Therefore, the macro-composite material is defined herein as including abrasion-resistant particles having a size from about 3 mm to about 50 mm, for example from about 3 mm to about 10 mm. In the case of spherical or substantially spherical particles, the size of the particles is defined by the particle diameter. In the case of all particles, regardless of shape, the particle size is defined as the smallest envelope dimension of the abrasion-resistant particles.

The relatively large size of the abrasion-resistant particles allows them to be detected by conventional ultrasonic testing equipment used for quality control of cast copper cooling elements, thereby permitting non-destructive testing to evaluate the presence of the abrasion-resistant particles in sufficient concentrations at the working face 24 of the stave coolers 12, 12', and the working faces 54, 58, 62 of tuyere cooler 42.

Factors that govern the interaction between the abrasion-resistant particles and the matrix are now described below.

1. Volumetric Packing Factor of Abrasion-Resistant Particles within the Unit Volume of the Macro-Composite Material The volumetric packing factor of the abrasion-resistant particles within the unit volume of the macro-composite can be varied anywhere between 0 to 100%, and is defined as the ratio of volume V of the abrasion-resistant particles to the unit volume $a^3$:

$$\text{Volumetric Packing Factor}=V/a^3.$$

Higher volumetric packing factor of the abrasion-resistant particles provides a higher proportion of the abrasion-resistant particles to the matrix. A proper volumetric balance is required for sufficient thermal conductivity and adequate wear resistance within the substantially repeating macro-composite engineered configuration. In this regard, a higher proportion of the abrasion-resistant particles within the macro-composite material provides enhanced wear resistance, since there is more of the abrasion-resistant material available at the working face 24, 54, 58, 62 and throughout the facing layer 22, 52, 64 to resist abrasion. Conversely, a higher proportion of the abrasion-resistant particles within the macro-composite material lowers the thermal conductivity of the macro-composite material, since the abrasion-resistant particles are less conductive than the first metal.

2. Front Face Area Packing Factor

The front face area packing factor of the abrasion-resistant particles within the unit volume $a^3$ may be varied anywhere from 0 to 100% on a Euclidean plane but, practically speaking, will range from about 20-100%. The front face area packing factor is defined as the ratio of the projected area of the abrasion-resistant particles (P.A.) to the projected area of the unit volume:

$$\text{Area Packing Factor}=\text{P.A.}/a^2.$$

A higher area packing factor of the abrasion-resistant particles contributes towards higher wear resistance and lower thermal conductivity of the macro-composite material. Therefore, a proper area packing factor is required for sufficient thermal conductivity and adequate wear resistance within the repeating macro-composite material.

3. Ratio of Interface Area Between the Abrasion-Resistant Particles and the Matrix to Volume of the Macro-Composite Material The interface area or surface area of contact between the abrasion-resistant particles and the second metal of the matrix represents the bonding area between the abrasion-resistant particles and the matrix and is denoted as S.A. More bonding area is beneficial since there is more area for thermal conduction between the abrasion-resistant particles and the matrix, and because there is more area to form a strong metallurgical bonds for retention of the abrasion-resistant particles within the matrix. The relationship between the shape and volume of the abrasion-resistant particles is governed by the surface area to volume ratio:

$$\text{Surface Area to volume Ratio}=\text{S.A.}/a^3$$

The value of S.A. can be as little as 0 where there is no contact between the aggregate and the matrix, and virtually has no upper boundary where there is an abundance of contact area. Adequate metallurgical bonding is responsible for retention of the abrasion-resistant particles and for enhanced wear resistance, since the abrasion-resistant particles are prevented from coming loose. The inventors have found that a minimum interface surface area (S.A.) of $0.25a^2$ and/or a minimum surface area to volume ratio ($S.A./a^3$) of 0.1 should be present for adequate performance of the macro-composite material.

4. Presence of Continuous Copper Tendrils Surrounding the Abrasion-Resistant Particles Inside the macro-composite material, the majority of heat transfer is performed by conduction through the metal matrix comprised of said second metal. Hence, it is desirable that the metal matrix includes metal tendrils surrounding the abrasion-resistant particles, and extending "in parallel" toward the working face 24, 54, 58, 62 of the facing layer 22, 52, 64. These tendrils allow for improved cooling of the macro-composite material, thereby preventing melting and resultant composite disintegration.

To illustrate the above principle, an analogy can be drawn with electrical circuits and with resistors connected in parallel and in series. Resistors connected in series yield a higher current resistance than ones connected in parallel. Heat behaves in an analogous manner. Thus, the metal tendrils, which have relatively low thermal resistivity, should each extend continuously towards the working face 24, 54, 58, 62 in between the abrasion-resistant particles, which have relatively high thermal resistivity, and furthermore should extend continuously from the working face 24, 54, 58, 62 through the entire thickness of the facing layer 22, 52, 64. This resembles resistors connected in parallel, where the total resistance is lower overall. On the other hand, if the metal tendrils run parallel to the working face 24, 54, 58, 62, between layers of abrasion-resistant particles, the total thermal resistivity is additive, thus resulting in relatively poor heat transfer.

5. Shape of the Abrasion-Resistant Particles and their Relative Spatial Orientation within the Macro-Composite Material The shape of the abrasion-resistant particles affects each of the factors listed above. Additionally, shape and orientation of the abrasion-resistant particles influence tribological interactions between the working face 24, 54, 58, 62 and the counter surface (i.e. the feed burden), as described below.

Less contact between the working face 24, 54, 58, 62 and the counter surface results in less friction and, thus, less wear, fretting, galling and erosion on the working face 24, 54, 58, 62. The use of abrasion-resistant particles having a spherical, cylindrical, curved or other deflecting shape yields beneficial results in this regard. When shape and orientation of the abrasion-resistant particles are optimized, the counter surface is deflected off the working face 24, 54, 58, 62 without causing substantial damage thereto. This reduces the probability of both abrasion and erosion at the working face 24, 54, 58, 62.

The abrasion-resistant particles should be properly anchored within the matrix to resist shear and bending loads induced by one or more motions such as sliding, rolling, rotation, etc. Therefore, it is recommended that any abrasion-resistant particles located at the working face should extend inside the matrix by at least 0.25 of their full length or diameter.

When material selection, and all the aforementioned factors are considered, and optimal values depending on the service environment are selected, the macro-composite material as defined herein achieves favourable wear resistance and thermal conductivity property values. Wear resistance of the macro-composite is measured by the wear rate using standardized ASTM G65 test, and thermal conductivity of the composite is measured on % IASC scale and in W/mK. Cast iron and copper are the two most widely used material choices for the first metal of the body 14, 44 of cooling element 12, 12', 42. Table 2 below compares thermal conductivity and wear resistance of conventional stave coolers comprised entirely of cast iron or copper to one made using the macro-composite material as described herein, and with a body 14, 44 comprised of copper. Table 2 clearly demonstrates that a cooling element 12, 12', 42 having a facing layer 22, 52, 64 comprised of the macro-composite material as defined herein has superior thermal conductivity and wear resistance properties over conventionally constructed cooling elements.

TABLE 2

Wear Rates and Thermal Conductivity of Macro-Composite vs. First Metal

| | Wear Rate | Thermal Conductivity | |
|---|---|---|---|
| Material | $mm^3$/30 min | % IACS | W/mK |
| Cast Iron | 170-342 | 13 | 55 |
| Copper | 382 | 100 | 385-400 |
| Macro-Composite | 41-382 | 20-86 | 80-344 |

To illustrate the effects of the aforementioned factors on the properties of the macro-composite material, several samples of macro-composite materials were devised. Table 3 and FIGS. 2, 2A to 2H, 5-1 to 5-8 and 7 illustrate these examples. For illustrative purposes, FIG. 2 shows a number of different types of macro-composite materials provided over some of the ribs of the stave cooler 12. The ribs having these various macro-composite materials are labeled 26-1 to 26-8 in FIG. 2.

FIGS. 2A to 2H illustrate the facing layers 22 of each of ribs 26-1 to 26-8 in greater detail. Each of the facing layers 22 shown in FIGS. 2A to 2H illustrate engineered configurations of macro-composite materials having differently shaped abrasion-resistant particles 66, wherein the abrasion-resistant particles 66 in each of these drawings are arranged in a substantially repeating, engineered configuration. It will be appreciated that the substantially repeating, engineered configuration of particles 66 is infiltrated with a matrix 70 comprised of the second metal. For purposes of clarity, the matrix 70 is not shown in FIGS. 2A to 2H.

FIGS. 5-1 to 5-8 each illustrate the unit volume of one of the macro-composite materials shown in FIGS. 2 and 2A-2H, also illustrating part of the matrix 70 of the second metal which forms the tendrils 68 as mentioned above. In each of FIGS. 5-1 to 5-8, arrow 74 defines the primary direction in which tendrils 68 extend through the matrix 70 to the surface 20 of facing layer 22, with some tendrils extending parallel to the surface 20 as shown in FIG. 5-8.

EXAMPLE 1

Spherical Abrasion-Resistant Particles

The sphere, as shown in FIGS. 2, 2A and 5-1, has an advantageous tribological shape since, essentially, it has a single tangential point of contact with no notches and grooves. Therefore, a cooling element 12, 12', 42 provided with a facing layer 22, 52, 64 comprised of a macro-composite material incorporating spherical abrasion-resistant particles 66 is expected to experience a low wear rate in use, due to decreased frictional sliding contact between the feed burden and the working face 24, 54, 58, 62 of the cooling element 12, 12', 42.

Figure 2A:
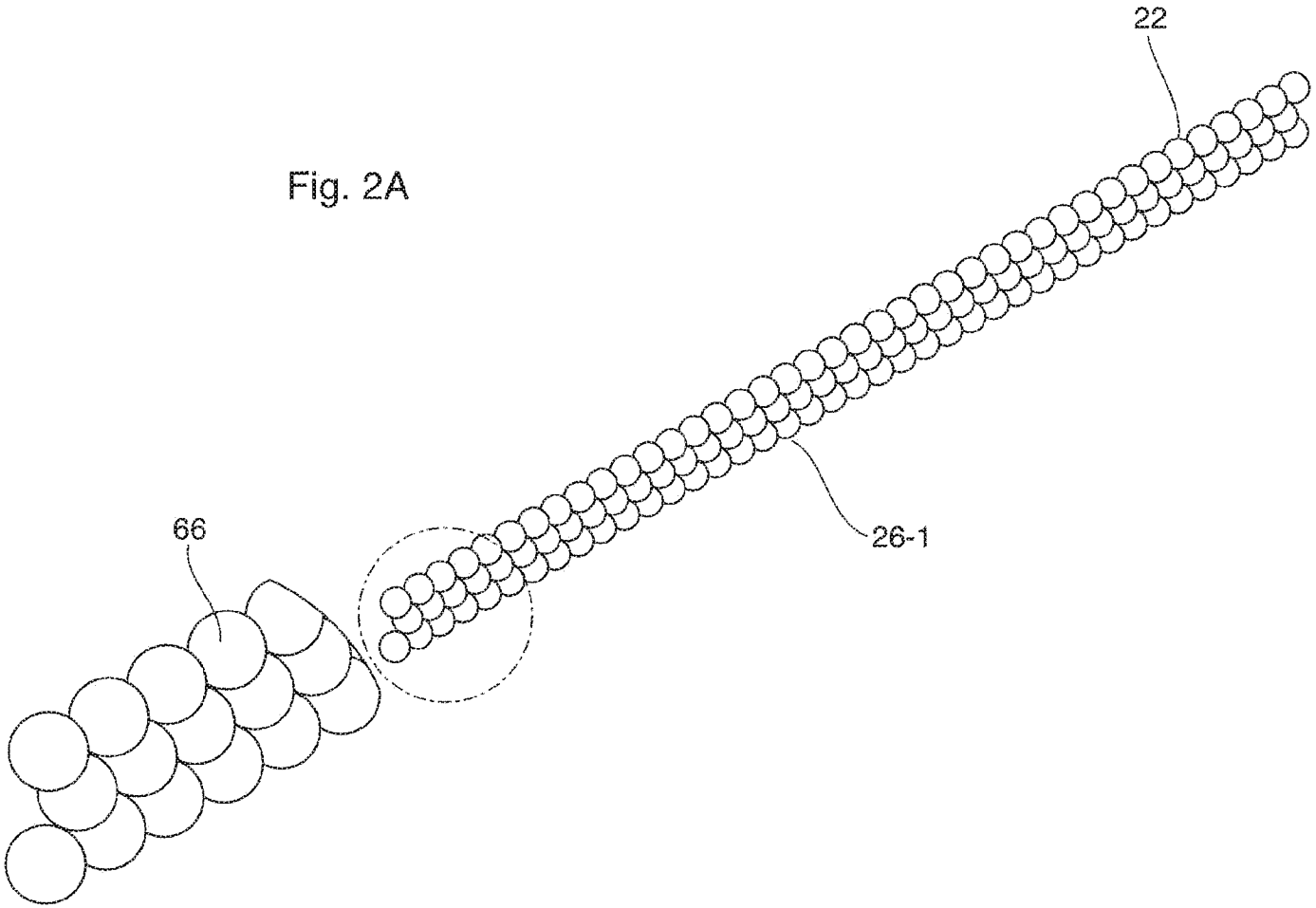
FIGS. 2A-2H illustrate the various facing layer configurations shown in FIG. 2, each of FIGS. 2A-2H including a close-up of a circled area to better show the shapes of the abrasion-resistant particles.
Figure 2B:
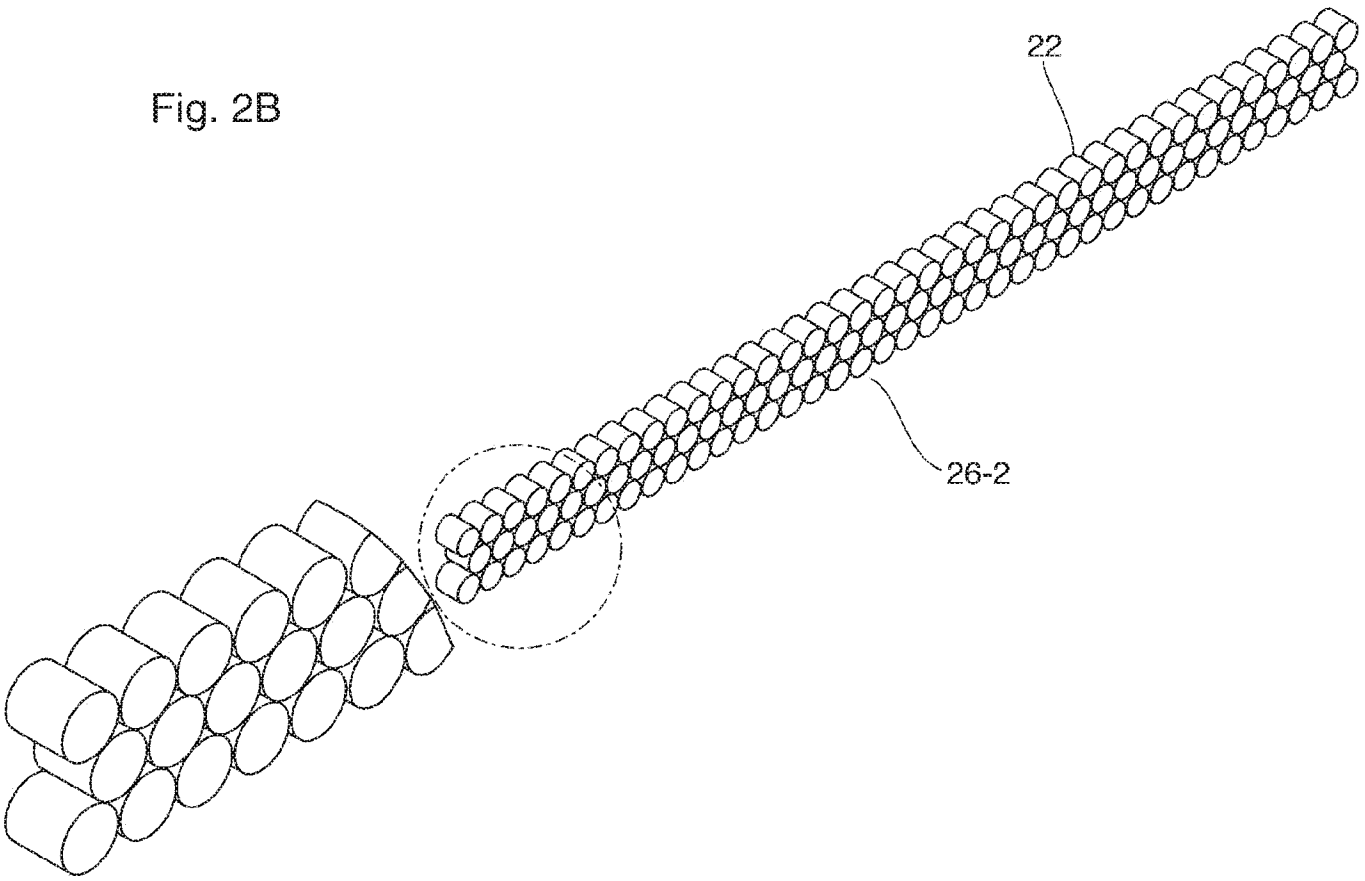
Figure 2C:
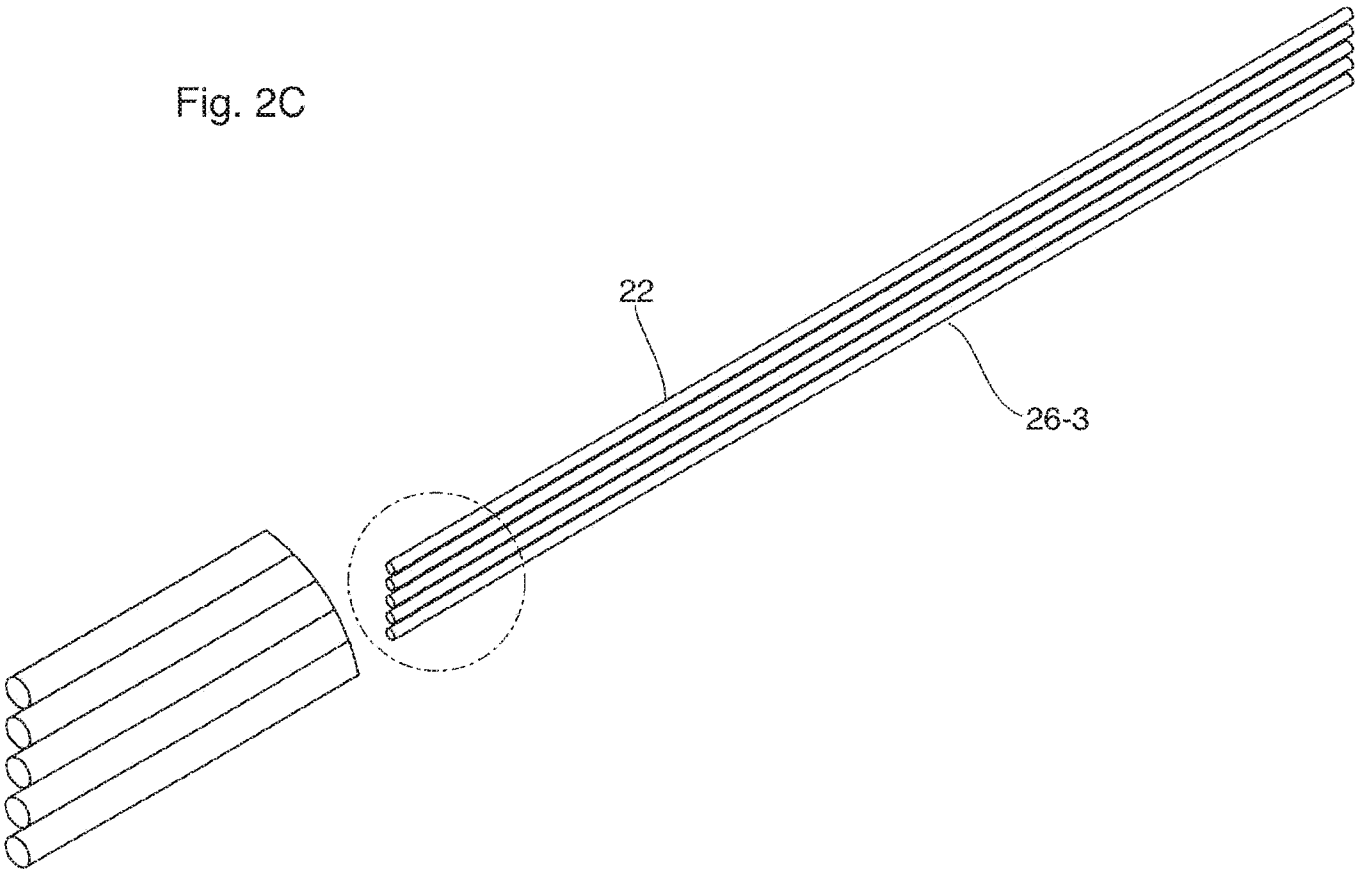
Figure 2D:
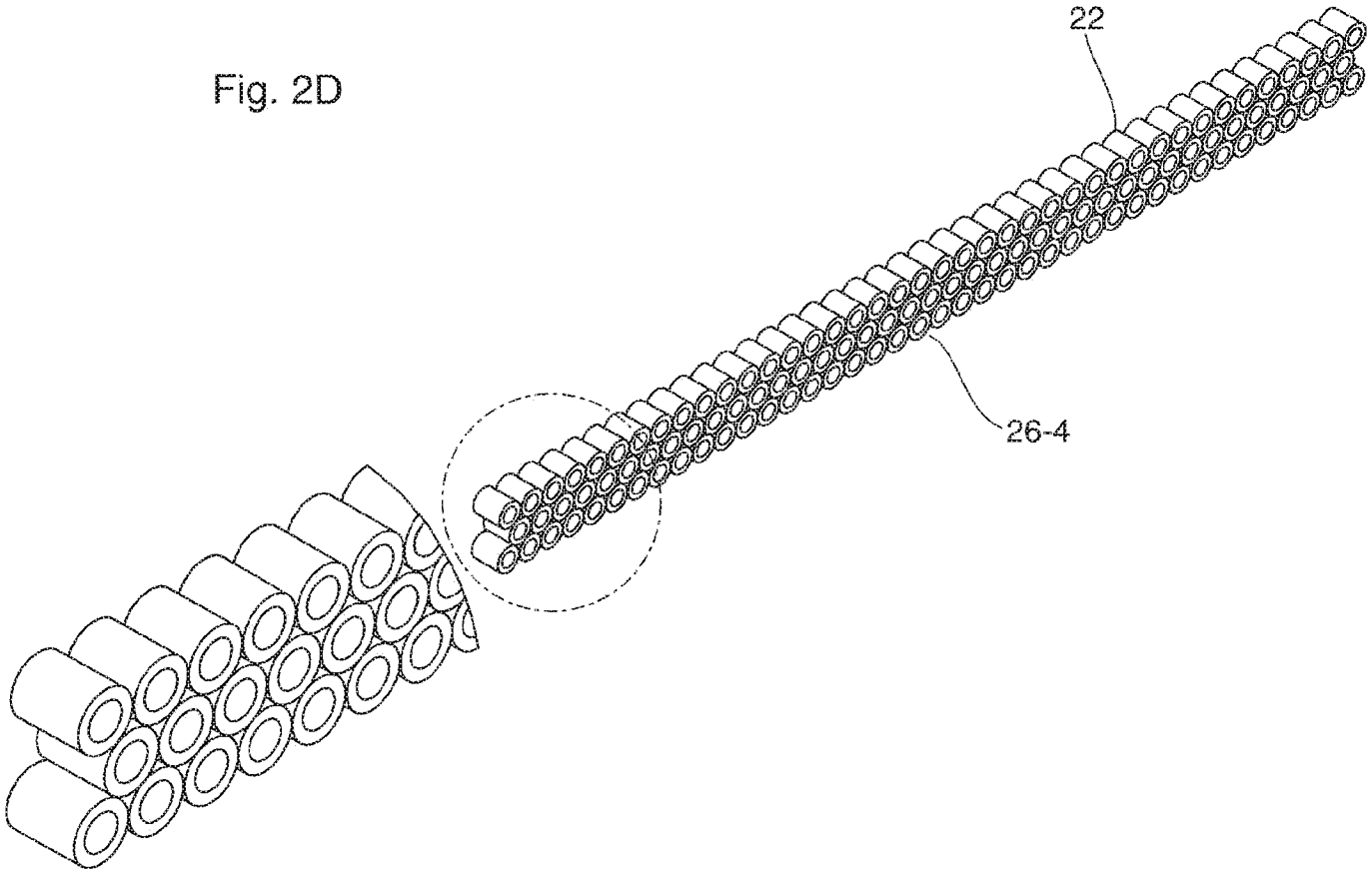
Figure 2E:
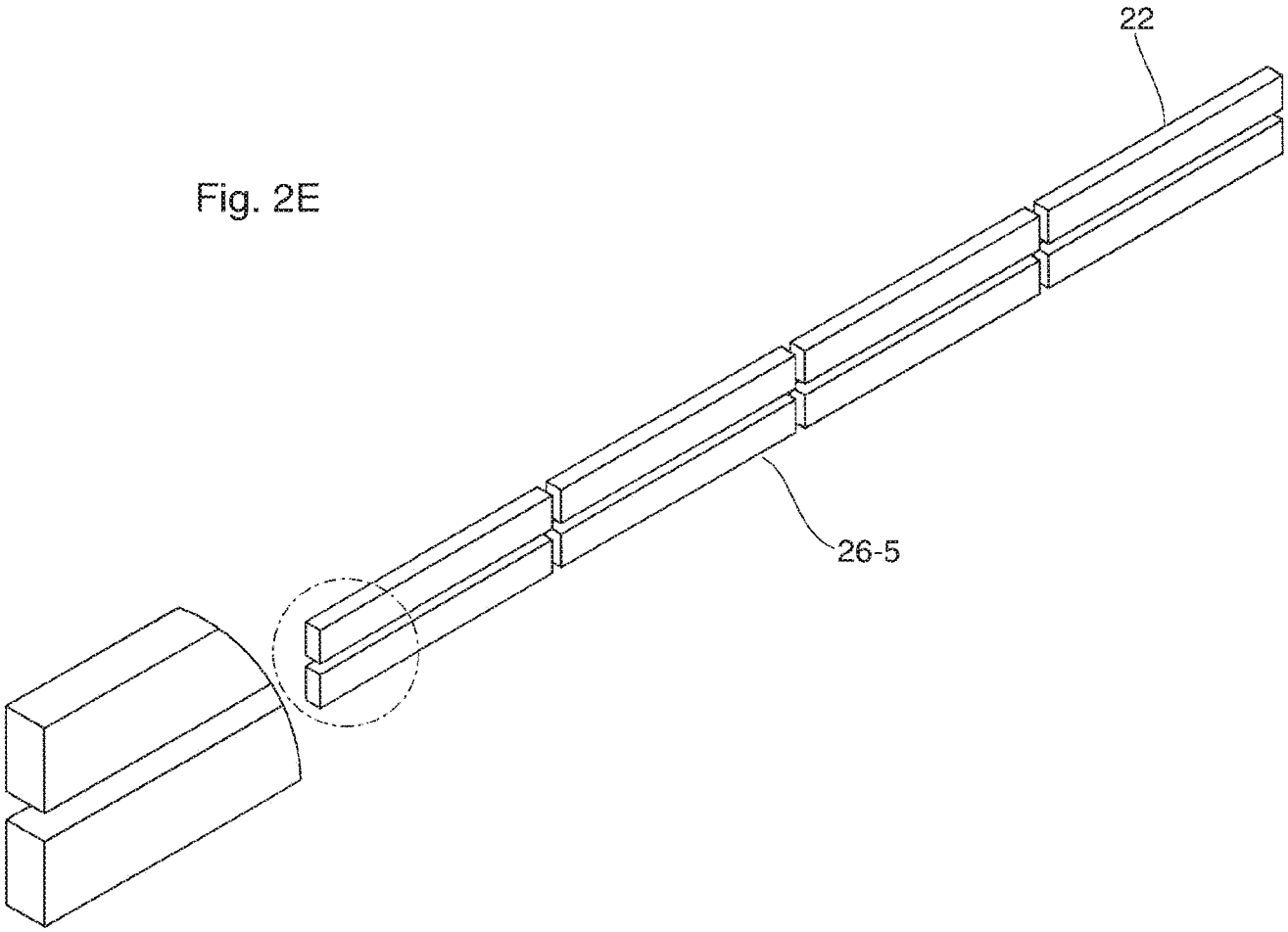
Figure 2F:
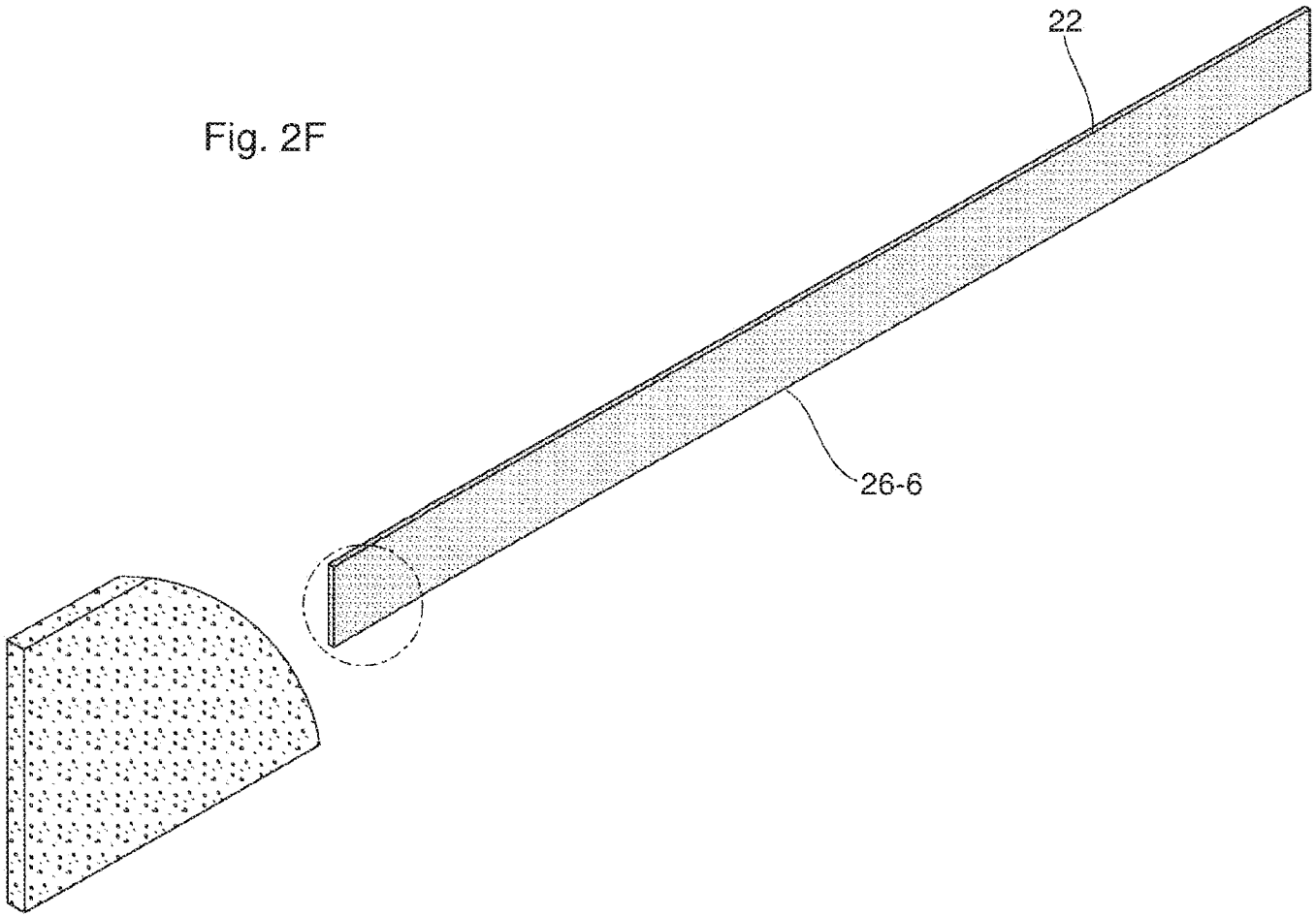
Figure 2G:
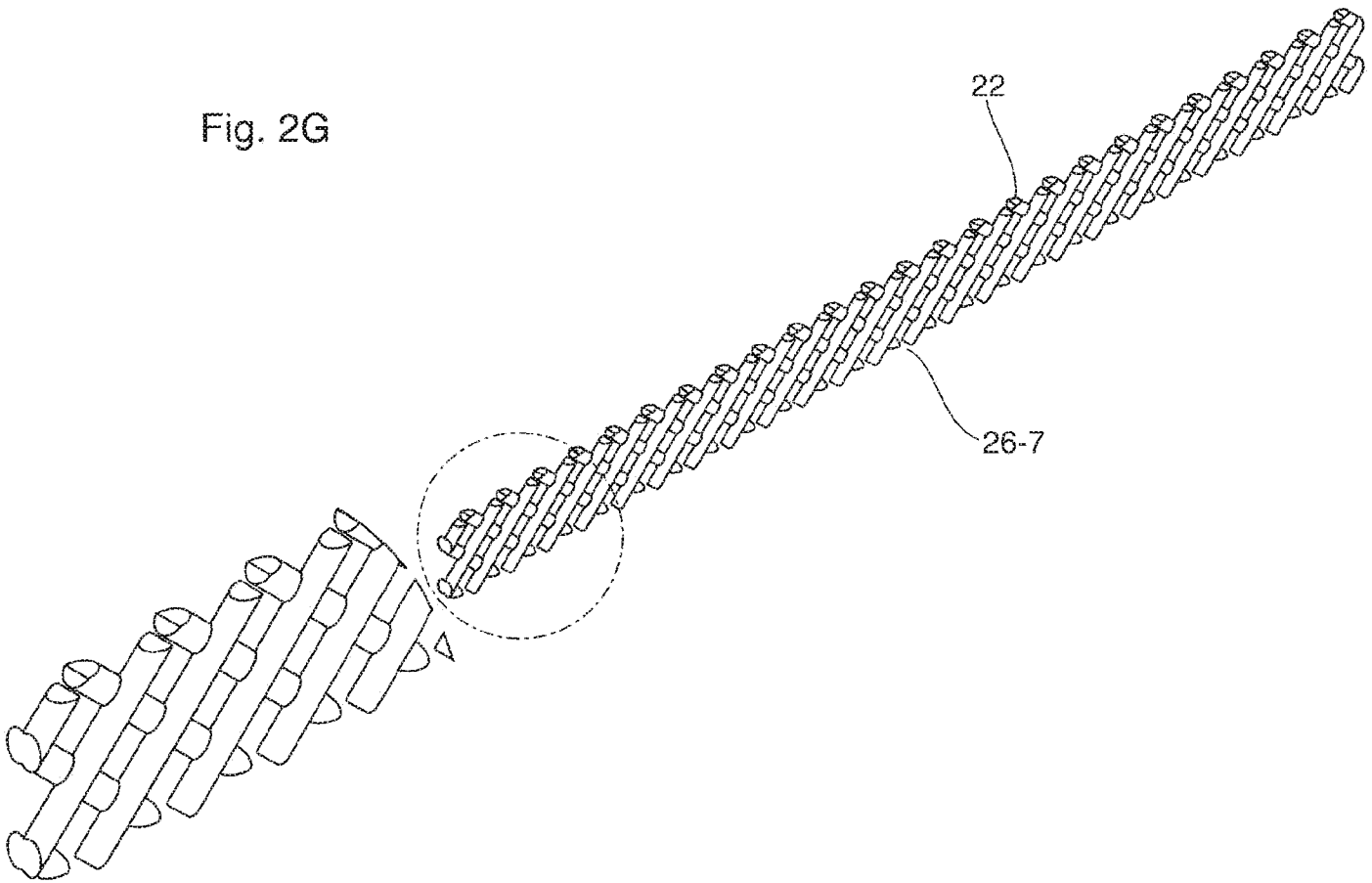
Figure 2H:
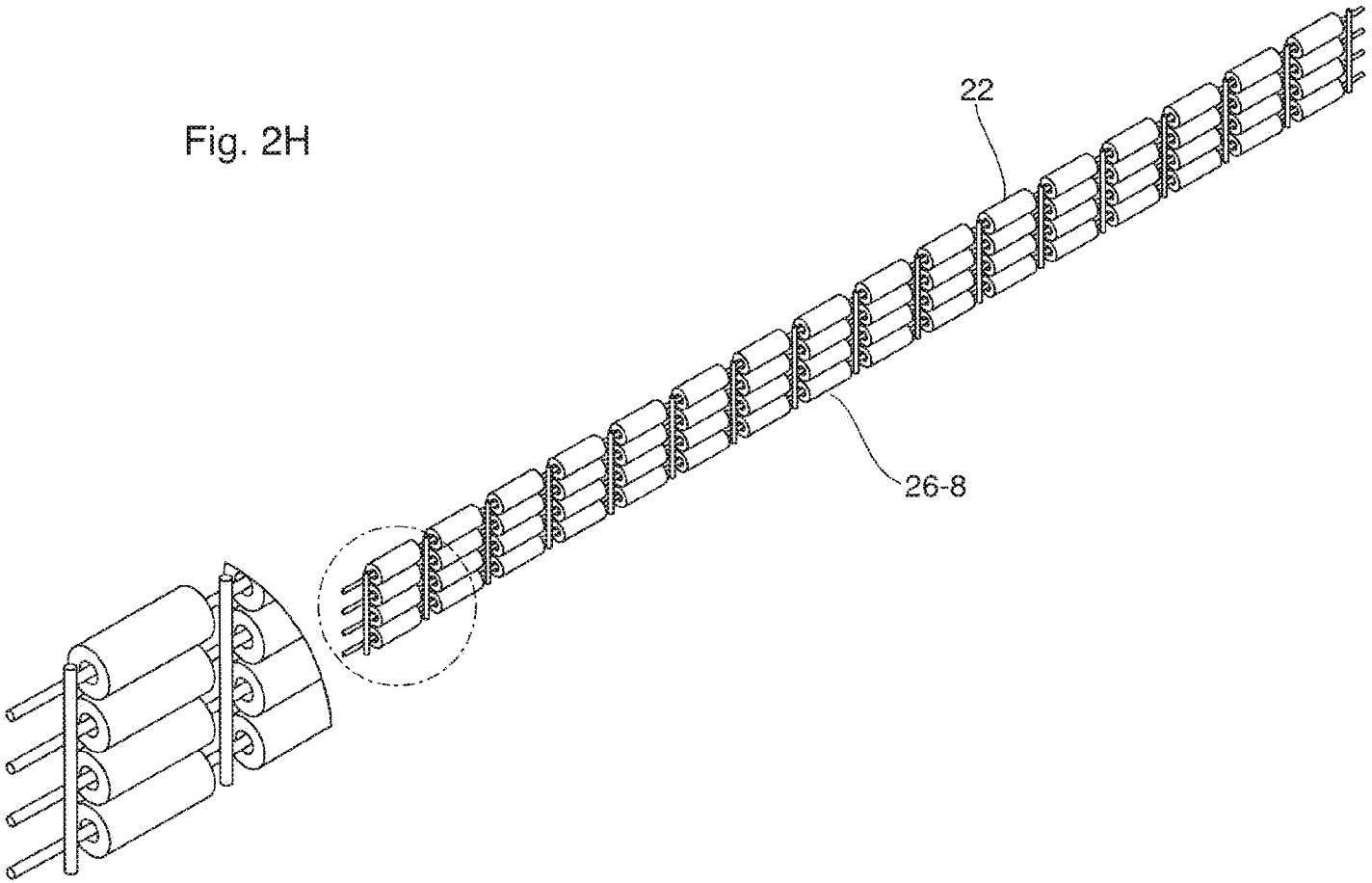
Figures 1, 5:
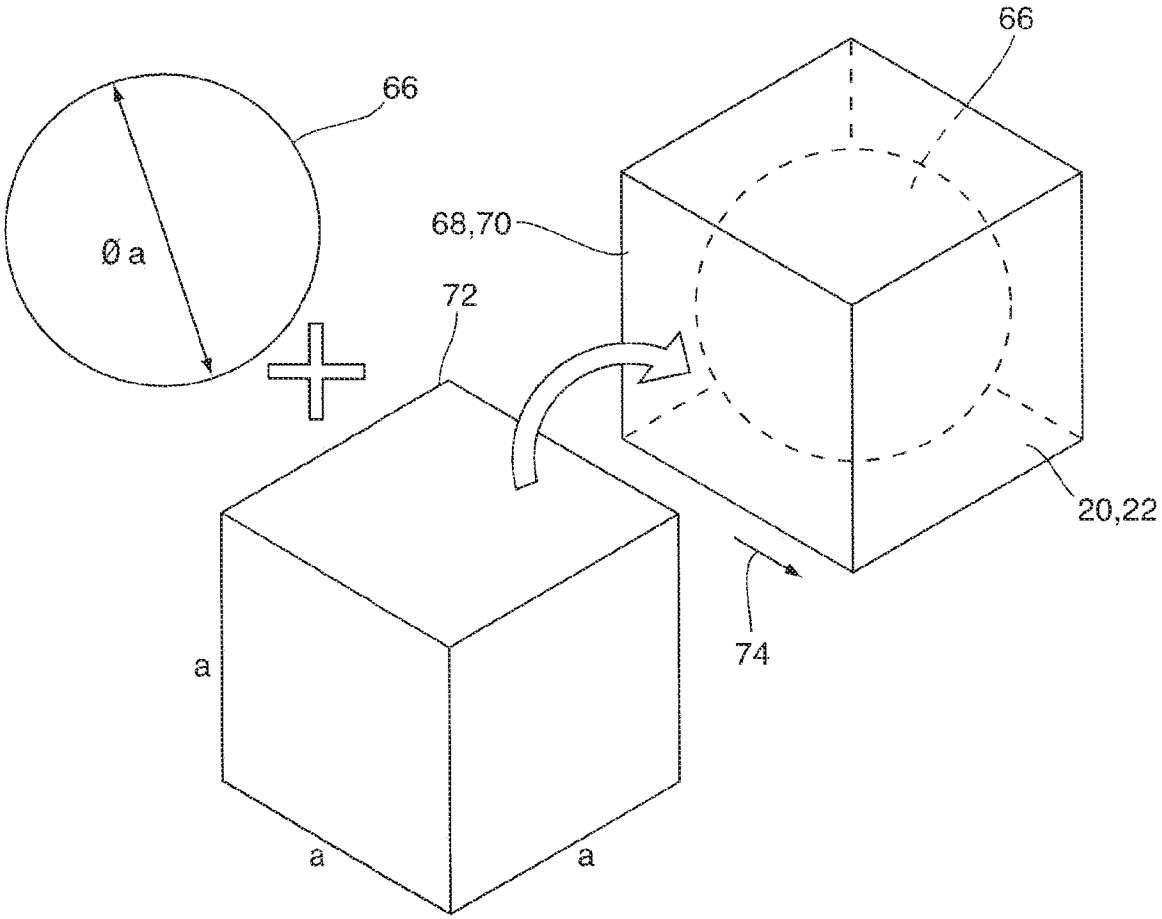
Figures 2, 5:
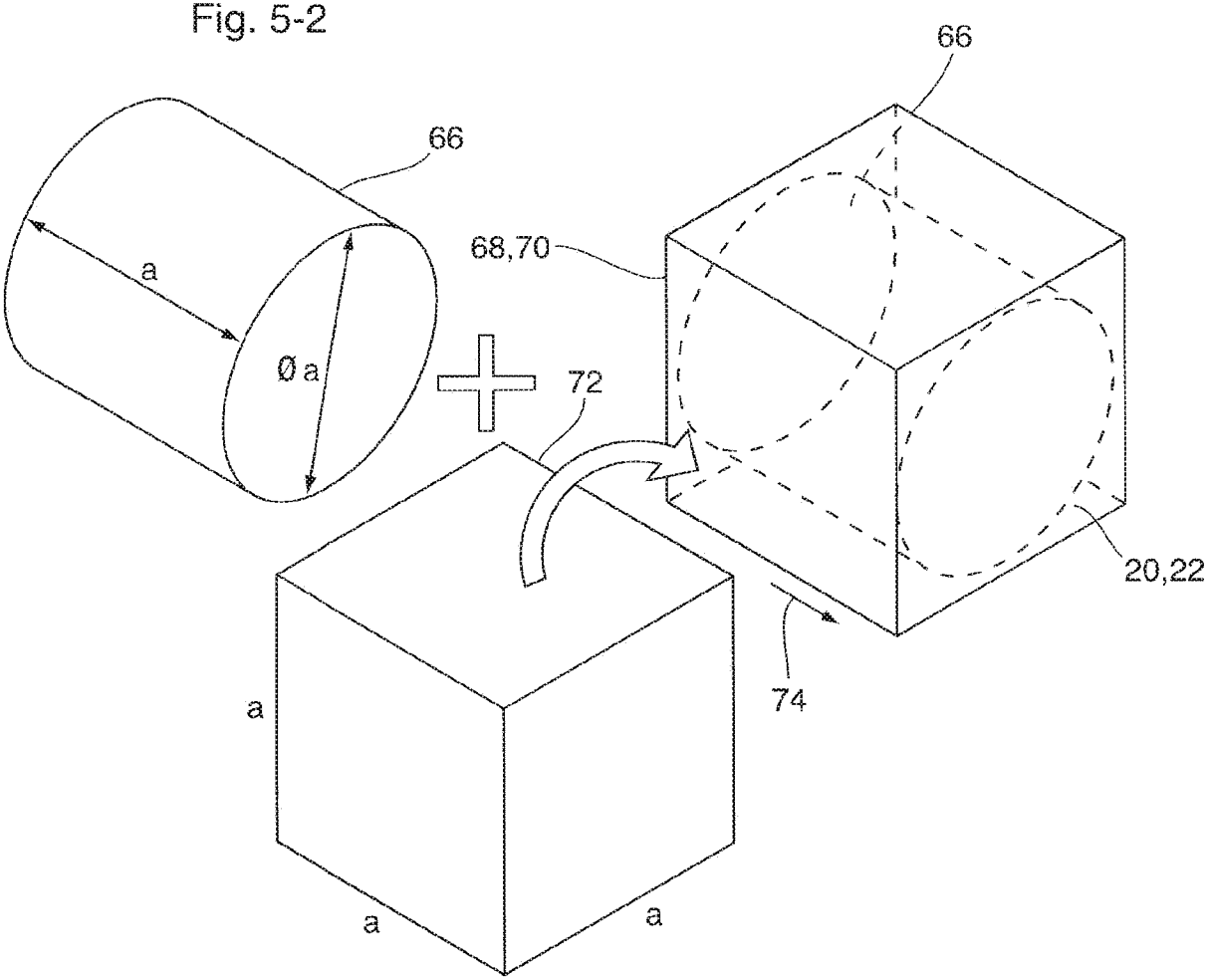
Figures 3, 5:
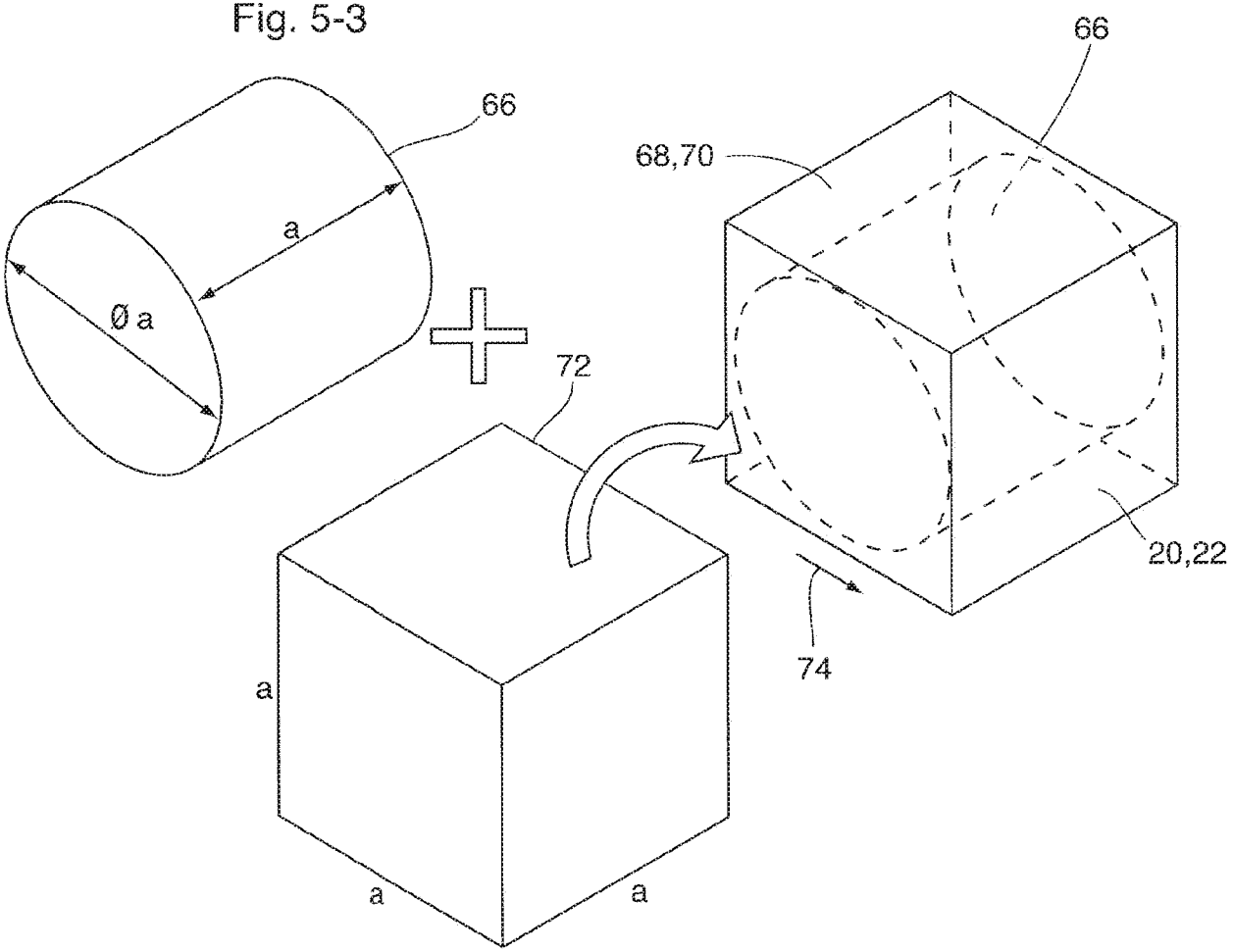
Figures 4, 5:
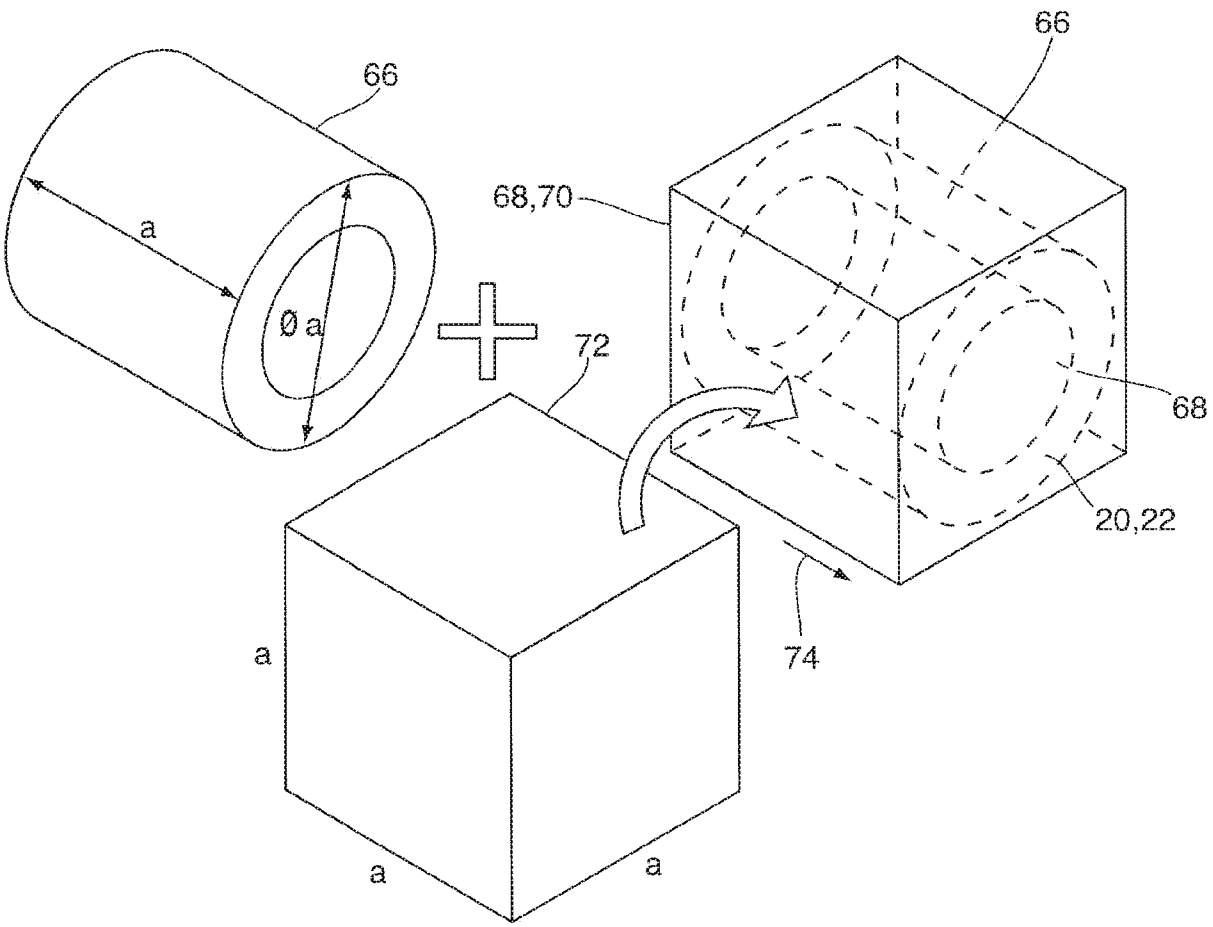
Figure 5:
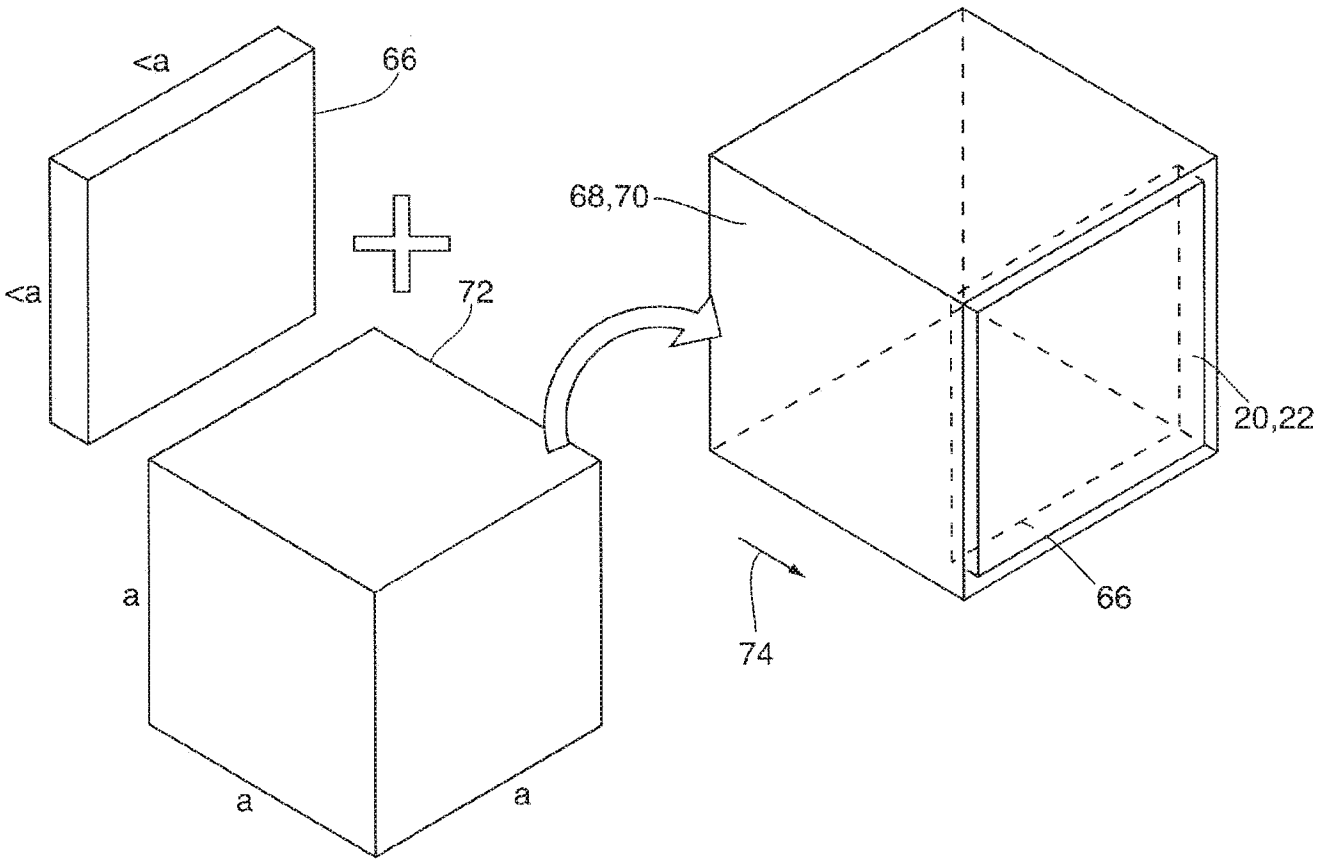
Figures 5, 6:
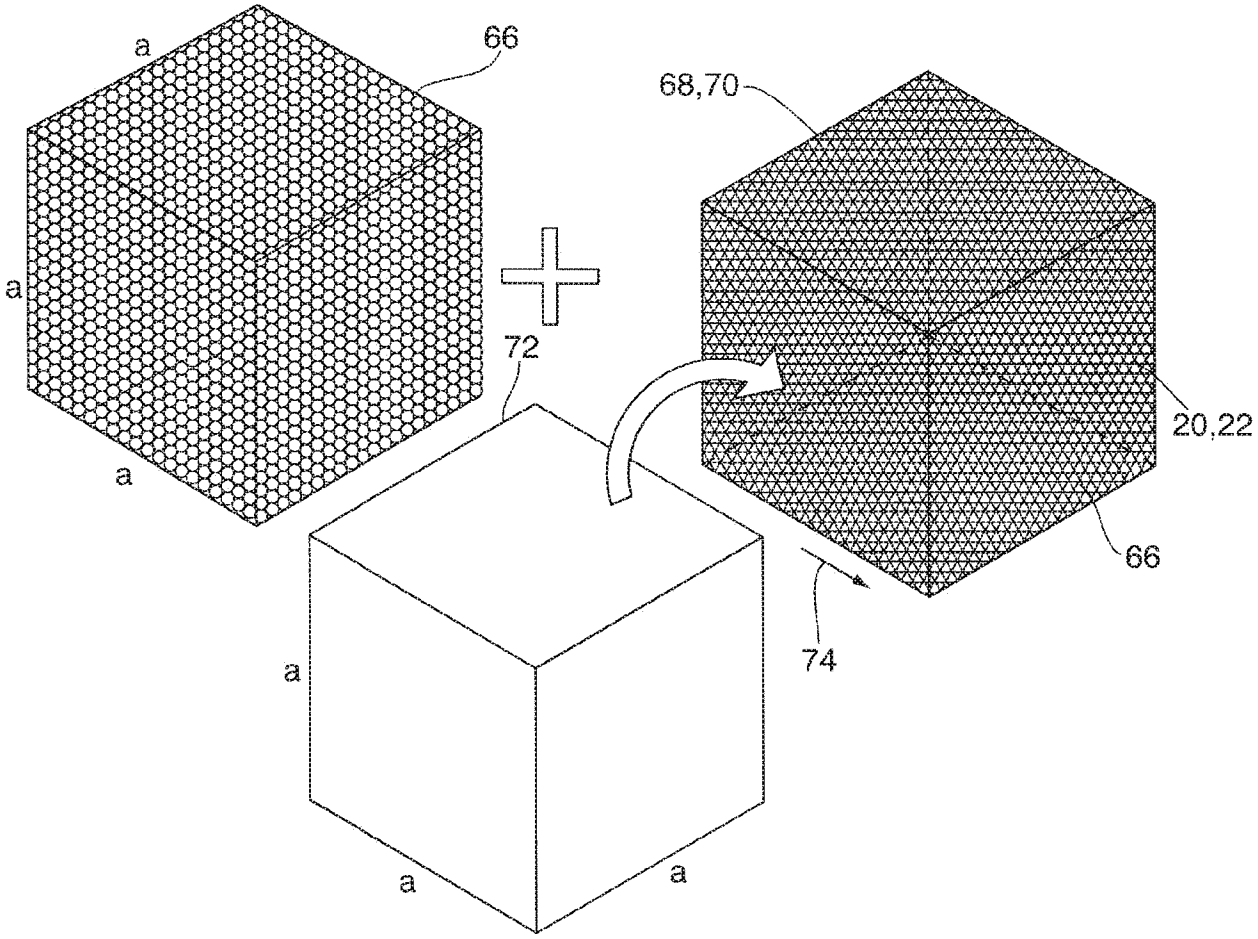

FIG. 5-1 illustrates a unit volume 72 of a macro-composite material comprising a copper matrix 70 and spherical abrasion-resistant particles 66 having diameter=a. Diameter a defines the envelope size of a composite unit cell, and is between 3-50 mm in diameter, for example 3-10 mm. A unit volume 72 of macro-composite material of this size results in a material with properties defined in Table 3. As an example, FIG. 2 illustrates a cooling element 12 in which the facing layer 22 shown on one of the horizontal ribs 26 (labelled 26-1 in FIG. 2) comprises a macro-composite material comprising the copper matrix 70 and spherical abrasion-resistant particles 66 of FIG. 5-1. The facing layer 22 may comprise a single layer of spherical abrasion-resistant particles 66 packed in a hexagonal area packing arrangement, as shown in FIGS. 2A and 6. It will be appreciated that the spherical particles 66 may instead be packed in a square area packing arrangement as shown in FIG. 6. The facing layers 22, 52, 64 of cooling elements 12', 42 may have the same or similar composition and structure.

EXAMPLE 2

Perpendicular Rod-Shaped Abrasion-Resistant Particles

A cylindrical rod oriented with its longitudinal axis perpendicular to the working face 24, 54, 58, 62 has an advantageous shape since the rod behaves as a beam which resists shear loads due to abrasion. Therefore, a cooling element 12, 12', 42 provided with a facing layer 22, 52, 64 comprised of a macro-composite material incorporating rod-shaped abrasion-resistant particles 66 oriented perpendicularly to surface 20 is expected to experience a low wear rate in use.

FIG. 5-2 illustrates a unit volume 72 of a macro-composite material comprising a copper matrix 70 and cylindrical rod-shaped abrasion-resistant particles 66 having diameter=a and length=a and oriented perpendicular to the front of the unit volume 72 defining the surface 20 of facing layer 22, which forms part of the working face 24, 54, 58, 62. Dimension a defines the envelope size of composite unit cell, and is between 3-50 mm in size, for example 3-10 mm. A unit volume of macro-composite material of this size results in a material with properties defined in Table 3. FIG. 2 illustrates a cooling element 12 in which the facing layer 22 shown on one of the horizontal ribs 26 (labelled 26-2 in FIG. 2) comprises a macro-composite material comprising the copper matrix 70 and the cylindrical rod-shaped abrasion-resistant particles 66 of FIG. 5-2. The facing layers 22, 52, 64 of cooling elements 12', 42 may have the same or similar composition and structure.

EXAMPLE 3

Parallel Rod-Shaped Abrasion-Resistant Particles

A cylindrical rod oriented with its longitudinal axis parallel to the working face 24, 54, 58, 62 has an advantageous tribological shape since during abrasion, the entire length of the cylindrical rod behaves as a deflector of the counter surface (feed burden). Therefore, a cooling element 12, 12', 42 provided with a facing, layer 22, 52, 64 comprised of a macro-composite material incorporating rod-shaped abrasion-resistant particles 66 oriented parallel to surface 20 is expected to experience a low wear rate in use, due to decreased frictional sliding contact between the feed burden and the working face 24, 54, 58, 62 of the cooling element 12, 12', 42.

FIG. 5-3 illustrates a unit volume 72 of a macro-composite material comprising a copper matrix 70 and cylindrical rod-shaped abrasion-resistant particles 66 having diameter=a and length=a, and oriented parallel to the front of the unit volume 72 defining the surface 20 of facing layer 22, which forms part of the working face 24, 54, 58, 62. Dimension a defines the envelope size of composite unit cell 72, and is between 3-50 mm in size, for example 3-10 mm. A unit volume 72 of macro-composite material of this size results in a material with properties defined in Table 3. FIG. 2 illustrates a cooling element 12 in which the facing layer 22 shown on one of the horizontal ribs 26 (labelled 26-3 in FIG. 2) comprises a macro-composite material comprising the copper matrix 70 and the cylindrical rod-shaped abrasion-resistant particles 66 of FIG. 5-3. The facing layers 22, 52, 64 of cooling elements 12', 42 may have the same or similar composition and structure.

EXAMPLE 4

Perpendicular Ring-Shaped Abrasion-Resistant Particles

A cylindrical ring (i.e. hollow cylinder) oriented with its longitudinal axis perpendicular to the working face 24, 54, 58, 62 has an advantageous shape since the ring behaves as a beam which resists shear loads due to abrasion. Therefore, a cooling element 12, 12', 42 provided with a facing layer 22, 52, 64 comprised of a macro-composite material incorporating ring-shaped abrasion-resistant particles 66 oriented perpendicularly to is expected to experience a low wear rate in use. Having an inner diameter, the ring-shape results in the formation of additional tendrils 68 of the metal matrix, and additional wetting (contact surface area) between the abrasion-resistant particles 66 and the metal matrix 70.

FIG. 5-4 illustrates a unit volume 72 of a macro-composite material comprising a copper matrix 70 and cylindrical ring-shaped abrasion-resistant particles 66 having diameter=a and length=a and oriented perpendicular to the front of the unit volume 72 defining the surface 20 of facing layer 22, which forms part of the working face 24, 54, 58, 62. Dimension a defines the envelope size of composite unit cell 72, and is between 3-50 mm in size, for example 3-10 mm. A unit volume of macro-composite material of this size results in a material with properties defined in Table 3. FIG. 2 illustrates a cooling element 12 in which the facing layer 22 shown on one of the horizontal ribs 26 (labelled 26-4 in FIG. 2) comprises a macro-composite material comprising the copper matrix 70 and the cylindrical ring-shaped abrasion-resistant particles 66 of FIG. 5-4. The facing layers 22, 52, 64 of cooling elements 12', 42 may have the same or similar composition and structure.

EXAMPLE 5

Plate-Shaped Abrasion-Resistant Particles

A plate, consisting of a single piece or a plurality of smaller pieces in close proximity to each other, located on the working face 24, 54, 58, 62 of a cooling element 12, 12', 42 has a benefit of full surface protection, which limits abrasive attack on the matrix material. Smaller pieces in close proximity to each other alleviate thermal fatigue of the joint between the aggregate and the matrix in cases where there is a large difference in thermal expansion coefficient. Therefore, a cooling element 12, 12', 42 provided with a facing layer 22, 52, 64 comprised of a macro-composite material incorporating plate-shaped abrasion-resistant particles 66 is expected to experience a low wear rate in use.

FIG. 5-5 illustrates a unit volume 72 of a macro-composite material comprising a copper matrix 70 and plate-shaped abrasion-resistant particles 66 with sides having length=a and oriented with their faces located along the front of the unit volume 72, defining the surface 20 of facing layer 22, and which forms part of the working face 24, 54, 58, 62. Dimension a defines the envelope size of composite unit cell 72, and is between 3-50 mm in size, for example 3-10 mm. A unit volume 72 of macro-composite material of this size results in a material with properties defined in Table 3. FIG. 2 illustrates a cooling element 12 in which the facing layer 22 shown on one of the horizontal ribs 26 (labelled 26-5 in FIG. 2) comprises a macro-composite material comprising the copper matrix 70 and the plate-shaped abrasion-resistant particles 66 of FIG. 5-5. Single or multiple plate-shaped particles 66 may be provided along the working face 24. In the illustrated embodiment, multiple plate-shaped particles 66 are provided in horizontal rib 26-5, with spaces between the plate-shaped particles defining tendrils 68 of the metal matrix 70. The facing layers 22, 52, 64 of cooling elements 12', 42 may have the same or similar composition and structure.

EXAMPLE 6

Foam Comprised of Abrasion-Resistant Particles

A foam, specifically open cell foam, located on the working face 24, 54, 58, 62 has a benefit of unlimited interface area, lighter weight, strong bond, multiple tendrils and ease of properties adjustment due to the porosity. Therefore, a cooling element 12, 12', 42 provided with a facing layer 22, 52, 64 comprised of a macro-composite material in the form of a foam 66 provides advantageous wear properties and ease of adjustability of properties.

FIG. 5-6 illustrates a unit volume 72 of a macro-composite material comprising a copper matrix 70 and abrasion-resistant particles 66, in the form of a foam. Dimension a defines the envelope size of composite unit cell, and is between 3-50 mm in size, for example 3-10 mm. A unit volume of macro-composite material of this size results in a material with properties defined in Table 3. FIG. 2 illustrates a cooling element 12 in which the facing layer 22 shown on one of the horizontal ribs 26 (labelled 26-6 in FIG. 2) comprises a macro-composite material comprising the copper matrix 70 and abrasion-resistant particles 66, in the form of a foam as in FIG. 5-6. The facing layers 22, 52, 64 of cooling elements 12', 42 may have the same or similar composition and structure.

EXAMPLE 7

Mesh Comprised of Abrasion-Resistant Particles

A mesh located on the working face 24, 54, 58, 62 has a benefit of large interface area, light weight and variable tribological properties due to changing mesh orientation. Therefore, a cooling element 12, 12', 42 provided with a facing layer 22, 52, 64 comprised of a macro-composite material in the form of a mesh 66 provides advantageous wear properties.

Figures 5, 6, 7:
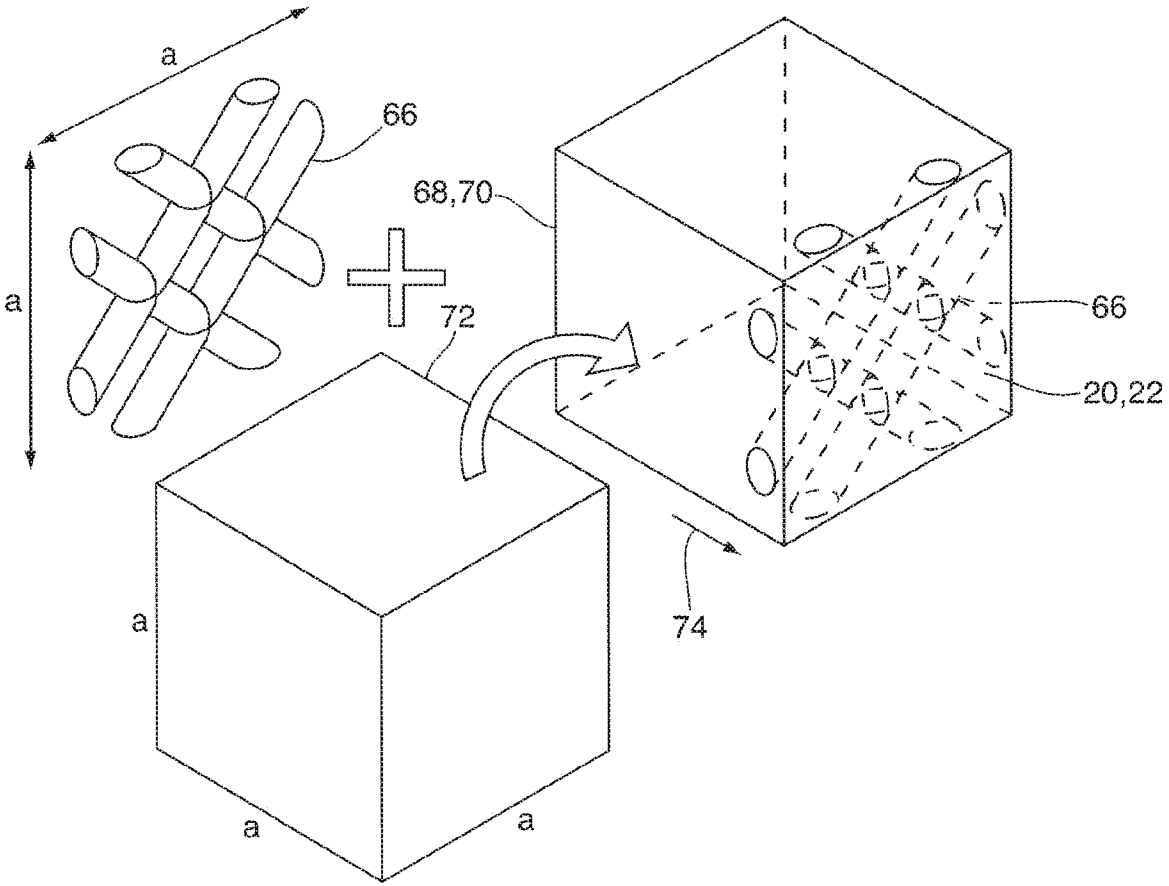
Figures 5, 6, 7, 8:
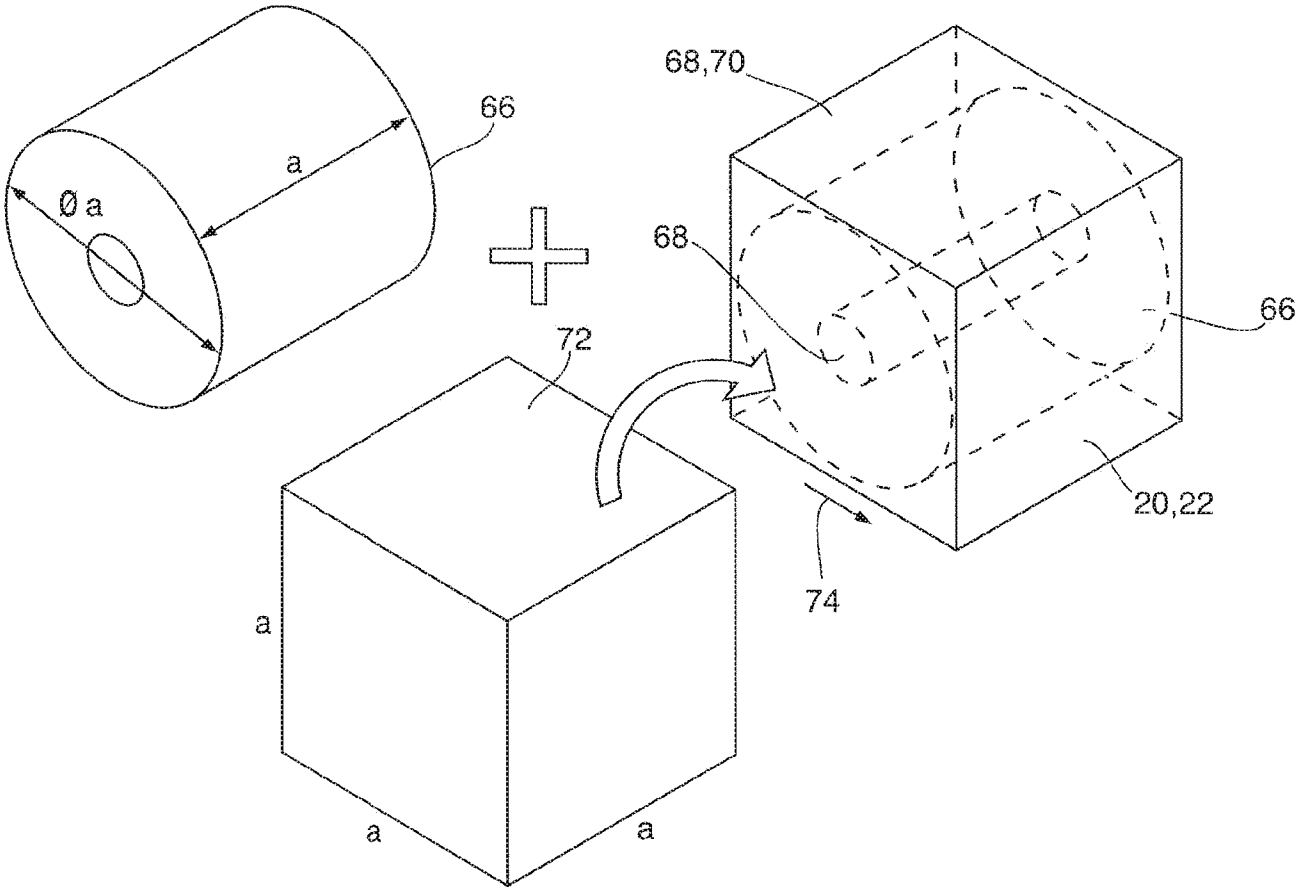
Figure 6:
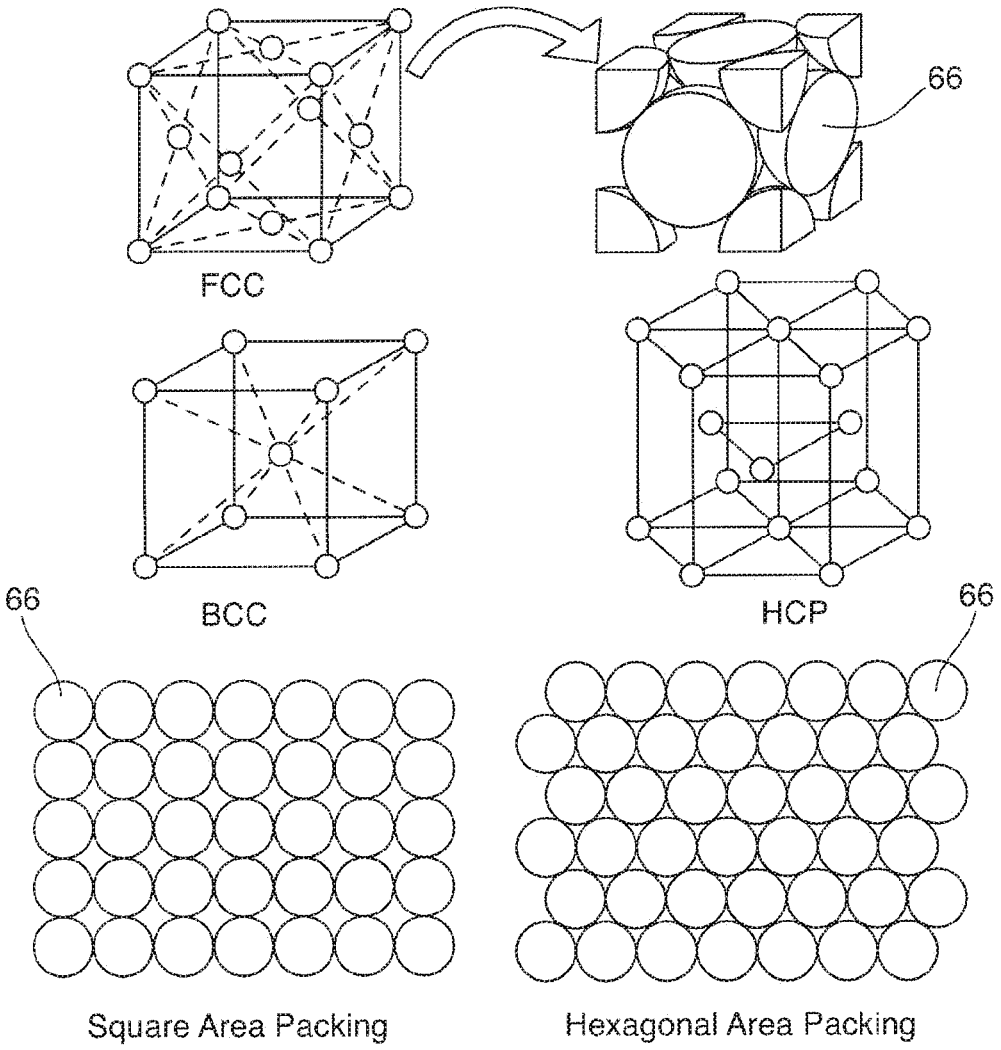
Figure 7:
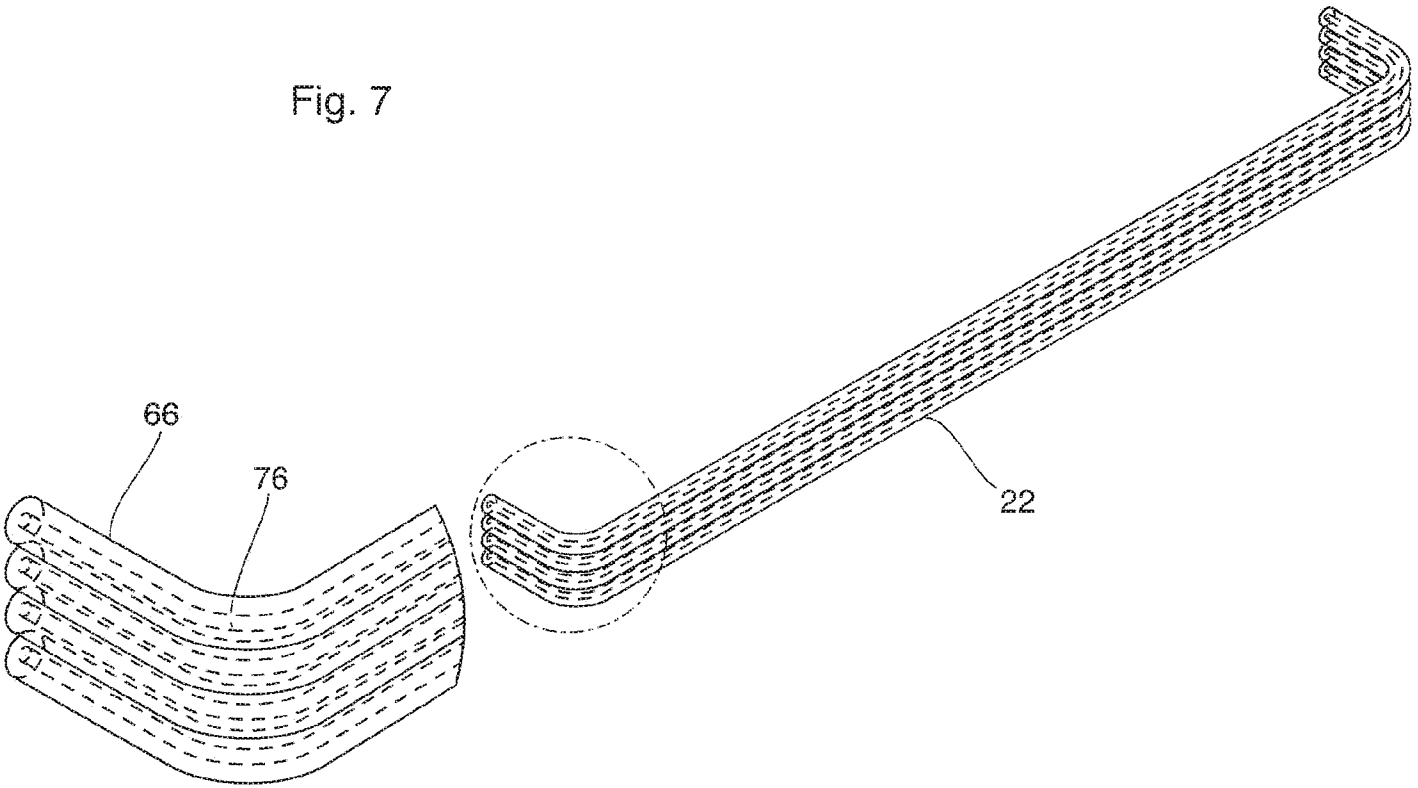

FIG. 5-7 illustrates a unit volume 72 of a macro-composite material comprising a copper matrix 70 and abrasion-resistant particles 66, in the form of a mesh. Dimension a defines the envelope size of composite unit cell 72, and is between 3-50 mm in size, for example 3-10 mm. A unit volume of macro-composite material of this size results in a material with properties defined in Table 3. FIG. 2 illustrates a cooling element 12 in which the facing layer 22 shown on one of the horizontal ribs 26 (labelled 26-7 in FIG. 2) comprises a macro-composite material comprising the copper matrix 70 and abrasion-resistant particles 66, in the form of a mesh as in FIG. 5-7. The facing layers 22, 52, 64 of cooling elements 12', 42 may have the same or similar composition and structure.

EXAMPLE 8

Parallel Bead-Shaped Abrasion-Resistant Particles

A cylindrical bead (hollow cylindrical rod) oriented with its longitudinal axis parallel to the working face 24, 54, 58, 62 has an advantageous tribological shape since during abrasion, the entire length of the cylindrical bead behaves as a deflector of the counter surface (feed burden). Therefore, a cooling element 12, 12', 42 provided with a facing layer 22, 52, 64 comprised of a macro-composite material incorporating bead-shaped abrasion-resistant particles 66 oriented parallel to working face 24, 54, 58, 62 is expected to experience a low wear rate in use, due to decreased frictional sliding contact between the feed burden and the working face 24, 54, 58, 62 of the cooling element 12, 12', 42. Having an inner diameter, the bead shape results in the formation of additional tendrils 68 of the metal matrix, and additional wetting (contact surface area) between the abrasion-resistant particles 66 and the metal matrix 70.

FIG. 5-8 illustrates a unit volume 72 of a macro-composite material comprising a copper matrix 70 and cylindrical bead-shaped abrasion-resistant particles 66 having diameter=a and length=a, and oriented parallel to the front of the unit volume 72 defining the surface 20 of facing layer 22, and which forms part of the working face 24, 54, 58, 62. Dimension a defines the envelope size of composite unit cell 72, and is between 3-50 mm in size, for example 3-10 mm. A unit volume 72 of macro-composite material of this size results in a material with properties defined in Table 3. FIG. 2 illustrates a cooling element 12 in which the facing layer 22 shown on one of the horizontal ribs 26 (labelled 26-8 in FIG. 2) comprises a macro-composite material comprising the copper matrix 70 and the cylindrical bead-shaped abrasion-resistant particles 66 of FIG. 5-3. The facing layers 22, 52, 64 of cooling elements 12', 42 may have the same or similar composition and structure.

TABLE 3

| | Examples | | | | | |
|---|---|---|---|---|---|---|
| Shape of Abrasion-Resistant Particles | Volumetric Packing Factor % | Front Face Area Packing Factor, % | Contact Surface to Volume Ratio | Continuous Copper Tendrils | Wear Rate, $mm^3$/30 min | Thermal Conductivity, W/mK |
| Example 1: Spherical Abrasion-Resistant Particles | 52-74 | 78-91 | >0.785 | YES | 41-90 | 80-175 |

TABLE 3-continued

| Examples | | | | | | |
|---|---|---|---|---|---|---|
| Shape of Abrasion-Resistant Particles | Volumetric Packing Factor % | Front Face Area Packing Factor, % | Contact Surface to Volume Ratio | Continuous Copper Tendrils | Wear Rate, $mm^3$/30 min | Thermal Conductivity, W/mK |
| Example 2-Perpendicular Rod-Shaped Abrasion-Resistant Particles | 78-91 | 78-91 | >3.927 | YES | 41-90 | >80 |
| Example 3-Parallel Rod-Shaped Abrasion-Resistant Particles | 78-91 | ≤100 | >3.927 | possible | >41 | >80 |
| Example 4-Perpendicular Ring-Shaped Abrasion-Resistant Particles | ≤91 | ≤91 | >3.927 | YES | >41 | >80 |
| Example 5-Plate-Shaped Abrasion-Resistant Particles | ≤99 | ≤99 | >0.01 | possible | >11 | >80 |
| Example 6-Foam Comprised of Abrasion-Resistant Particles | ≤99 | ≤100 | >0.01 | YES | >11 | >80 |
| Example 7-Mesh Comprised of Abrasion-Resistant Particles | ≤99 | ≤100 | >0.01 | YES | >11 | >80 |
| Example 8-Parallel Bead-Shaped Abrasion-Resistant Particles | ≤91 | ≤100 | >3.927 | YES | >11 | >80 |
| Prior Art | 10 | 78-91 | >0.785 | possible | 58-65 | 60-77 |

As mentioned above, the thickness (or depth) of the facing layer 22, 52, 64 may be from about 3 mm to about 50 mm. To provide a sufficient thickness, the facing layer 22, 52, 64 may comprise either a single or multiple layers of the abrasion-resistant particles in the facing layer 22, 52, 64, stacked one on top of the other.

According to another aspect, there is provided a method for economically producing the cooling elements as described herein by using a negative mould of the cooling element, positioning in the mould cavity an engineered configuration of abrasion-resistant particles, and introducing molten metal into the mould cavity.

The mould can be a conventional sand-casting mould, or a permanent graphite mould. The use of a permanent mould is advantageous as it allows multiple re-use of the mould, and may produce castings with better dimensional tolerances. These characteristics of the permanent mould reduce mould making costs and machining costs, respectively, thereby lower the production costs of cooling element.

The positioning of the abrasion-resistant particles in the engineered configuration can be done in-situ or by using pre-fabricated assemblies of aggregate positioned in the mould. The latter is advantageous because it allows for better manufacturing and quality control, bond of metal with the abrasion-resistant particles, thermal conductivity, and decreased casting preparation time.

Although FIG. 2 shows a cooling element 12 in the form of a stave cooler for a blast furnace as having a corrugated structure with plurality of even horizontal ribs 26 and plurality of horizontal valleys 28, it will be appreciated that the embodiments that have been disclosed herein are generally applicable to cooling elements 12 of various configurations, sizes and shapes, which are subjected to wear by contact with hard, abrasive particulate material within a metallurgical furnace. For example, as shown in FIG. 3, the facing layer 22/working face 24 of stave cooler 12' has a broad level surface but little height or depth. Thereby, the entire working face 24 of stave cooler 12' is exposed to contact with the descending column of feed burden 6 (FIG. 1).

Although FIG. 4 shows a cooling element in the form of a tuyere cooler 42 for a blast furnace as having a conical structure with first working face 54, it will be appreciated that the embodiments that have been disclosed herein are generally applicable to cooling elements 42 of various configurations, sizes and shapes, which are subjected to wear by abrasion and erosion of inner and outer walls of the tuyere cooler through coke, or another fuel that has been injected through the tuyere cooler, and by abrasion and erosion due to the direct contact with furnace charge consisting of alternating layers of ore burden (sinter, pellets, lump ore), and coke.

FIG. 7 shows a variant of the macro-composite material comprising the copper matrix 70 and the cylindrical rod-shaped abrasion-resistant particles 66 extending parallel to the surface 20 of facing layer 22, described above with reference to FIG. 2 (rib 26-3), 2C and FIG. 5-3. In the embodiment of FIG. 7, the rod-shaped particles 66 are hollow, having internal passages 76 for flow of a coolant. The ends of the rod-shaped particles 66 are angled at 90 degrees relative to the central portion, so as to wrap around the edges of the stave cooler 12 to connect to a coolant manifold and to coolant conduits 18. This embodiment therefore provides water cooling to the working faces of the coolers.

Although the invention has been described in connection with certain embodiments, it is not limited thereto. Rather, the invention includes all embodiments which may fall within the scope of the following claims.

What is claimed is:

1. A cooling element for a metallurgical furnace, the cooling element comprising a body comprised of a first metal and a facing layer, the facing layer providing a working face for the cooling element, the facing layer comprised of a composite material, the composite material comprising abrasion-resistant particles arranged in a repeating pattern to define spaces therebetween, and tendrils within the spaces, the tendrils having a consistent thickness along their lengths and formed by infiltrating the spaces with a second metal.

2. The cooling element of claim 1, wherein all of the abrasion-resistant particles are substantially the same size and shape.

3. The cooling element according to claim 1, wherein the abrasion-resistant particles have a hardness of at least about 6.5 Mohs.

4. The cooling element according to claim 1, wherein the second metal is the same type of metal as the first metal.

5. The cooling element according to claim 1, wherein the second metal is a high copper alloy having a copper content of at least about 96 weight percent.

6. The cooling element according to claim 1, wherein the composite material has an abrasive wear rate, of no more than 0.6 times that of grey cast iron under identical conditions.

7. The cooling element according to claim 1, wherein the facing layer has a thickness from about 3 mm to about 50 mm.

8. The cooling element according to claim 1, wherein the spaces between the abrasion-resistant particles define at least a portion of the tendrils of the second metal.

9. The cooling element according to claim 1, wherein the abrasion-resistant particles have a size from about 3 mm to about 10 mm.

10. The cooling element according to claim 1, wherein all of the spaces between the abrasion-resistant particles are substantially the same.

11. The cooling element according to claim 1, wherein the tendrils extend toward the working face.

12. The cooling element according to claim 1, wherein any of said abrasion-resistant particles located at a working face extend into the composite material by at least 0.25 of their length or diameter.

13. The cooling element according to claim 1, wherein at least a portion of the tendrils surround the abrasion-resistant particles and extend toward the working face.

14. The cooling element according to claim 1, wherein the abrasion-resistant particles are cylindrical, with each of the abrasion-resistant particles having a longitudinal axis that is parallel to the working face.

15. The cooling element according to claim 14, wherein each of the cylindrical abrasion-resistant particles has a hollow interior which is infiltrated by the second metal to form a tendril.

16. The cooling element according to claim 1, wherein the abrasion-resistant particles comprise particles of foam or mesh.

17. The cooling element according to claim 1, wherein the abrasion-resistant particles are cylindrical, with each of the abrasion-resistant particles having a longitudinal axis that is perpendicular to the working face.

18. The cooling element according to claim 1, wherein the spaces between the abrasion-resistant particles are completely infiltrated with the second metal.

19. The cooling element according to claim 1, wherein the abrasion-resistant particles of the facing layer are comprised of one or more of ceramics, including carbides, nitrides, borides, and oxides.

20. The cooling element according to claim 18, wherein:

the carbides comprise one or more of tungsten carbide, niobium carbide, chromium carbide and silicon carbide;

the nitrides comprise one or more of aluminum nitride and silicon nitride;

the oxides comprise one or more of aluminum oxide and titanium oxide; and the borides comprise silicon boride.

21. The cooling element according to claim 1, wherein the second metal comprises: cast iron; steel, including stainless steel; copper; and alloys of copper, including copper-nickel alloys.

22. The cooling element according to claim 1 wherein the tendrils form part of the working face.

23. The cooling element according to claim 1, wherein the abrasion-resistant particles are independent of one another.

24. The cooling element according to claim 1, wherein the facing layer comprises a single layer of the abrasion-resistant particles packed in a hexagonal area packing arrangement.

25. The cooling element according to claim 1, wherein the abrasion resistant particles comprises plate-shaped abrasion resistant particles, and wherein a face of each of the plate-shaped abrasion-resistant particles forms part of the working face.

26. The cooling element according to claim 25, wherein the spaces between each of the faces of the plate-shaped particles forming the working face define the tendrils of the second metal.

27. The cooling element according to claim 26, wherein one or more of the plate-shaped particles is surrounded by the tendrils.

28. The cooling element according to claim 1, wherein the body is provided with one or more internal cavities defining one or more coolant flow passages.

* * * * *